US007409929B2

(12) United States Patent
Miyahara et al.

(10) Patent No.: US 7,409,929 B2
(45) Date of Patent: Aug. 12, 2008

(54) COOLING APPARATUS FOR INTERNAL COMBUSTION ENGINE

(75) Inventors: Hideki Miyahara, Toyota (JP); Tokiji Ito, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 4 days.

(21) Appl. No.: 11/494,527

(22) Filed: Jul. 28, 2006

(65) Prior Publication Data

US 2007/0175414 A1 Aug. 2, 2007

(30) Foreign Application Priority Data

Jul. 29, 2005 (JP) ..... 2005-222202

(51) Int. Cl.
*F01P 7/00* (2006.01)
*F01P 7/14* (2006.01)
*F01P 7/16* (2006.01)

(52) U.S. Cl. ..... 123/41.05; 123/41.1; 236/34.5

(58) Field of Classification Search ..... 123/41.1, 123/41.01, 14.05, 41.15; 703/114; 236/34.5
See application file for complete search history.

(56) References Cited

U.S. PATENT DOCUMENTS 4,271,795 A * 6/1981 Nakagawa et al. ..... 123/308
6,694,246 B2 * 2/2004 Masuda et al. ..... 123/41.1
2005/0224019 A1 * 10/2005 Kim ..... 123/41.1
2005/0228577 A1 * 10/2005 Wakahara et al. ..... 701/114

FOREIGN PATENT DOCUMENTS

| | | |
|---|---|---|
| JP | 9-68028 | 3/1997 |
| JP | 2000-220456 | 8/2000 |
| JP | 2004-232519 | 8/2004 |

* cited by examiner

*Primary Examiner*—Stephen K. Cronin
*Assistant Examiner*—Ka C Leung
(74) *Attorney, Agent, or Firm*—Oblon, Spivak, McClelland, Maier & Neustadt, P.C.

(57) ABSTRACT

A cooling apparatus includes a thermostat that adjusts a feed rate of coolant to a radiator, estimating means that estimates a coolant temperature simulated value at least based on the detection value of an intake-air temperature sensor, and diagnosis means that diagnoses an operating state of the thermostat by comparing the detection value of a coolant temperature sensor, and the coolant temperature simulated value when a diagnosis condition is established. When a ratio of an integrated value of the simulated water temperature variation in an idle state to the integrated value of the simulated water temperature variation in a normal driving state is equal to or greater than an upper limit ratio XP, the diagnosis of the operating state of the thermostat is prohibited.

19 Claims, 14 Drawing Sheets

COOLING APPARATUS FOR INTERNAL COMBUSTION ENGINE

BACKGROUND OF THE INVENTION

The present invention relates to a cooling apparatus for an internal combustion engine that performs diagnosis of an operating state of a thermostat.

In an internal combustion engine, a phenomenon (stuck-open valve) often occurs in which a valve inside the thermostat is in an opened state and yet does not operate. In a state in which the stuck-open valve occurs (at the abnormal state of the thermostat), a coolant is always circulated through a radiator, and therefore, the temperature of the coolant is hard to rise as compared with the normal state of the thermostat.

In a conventional cooling apparatus, anomaly of the thermostat is detected by paying attention to a change of the temperature of the coolant through the following processes (A) and (B).

(A) Based on the parameter having a correlation to the coolant temperature, a reference temperature equivalent to the coolant temperature is calculated when an operating state of the thermostat is normal.

(B) When a diagnosis condition is established, the reference temperature and the actual coolant temperature are compared, thereby to diagnose on the operating state of the thermostat. That is, when a ascending degree of the reference temperature is greater than the ascending degree of the actual coolant temperature, it is determined that an anomaly is developed in the thermostat.

In the cooling apparatus disclosed in Japanese Laid-Open Patent Publication No. 2000-220456, attention is paid to the fact that a difference between the coolant temperature and the external air temperature affects a heat dissipation rate of the coolant. That is, based on that temperature difference, the reference temperature is calculated, so that the anomaly of the thermostat is detected. Further, for the calculation of the temperature difference, the detection value of an intake-air temperature sensor is used as the value equivalent to the external air temperature.

Since the intake-air temperature sensor rises in its temperature by heat reception from the engine, the detection value of the sensor shows values greater than the actual external air temperature.

Hence, in the cooling apparatus disclosed in Japanese Laid-Open Patent Publication No. 2000-220456, in case a ascending degree of the temperature of the intake-air temperature sensor is excessively great, a diagnosis of the operating state is performed based on the reference temperature sharply deviated from a predetermined value, and it is, therefore, not possible to accurately detect the anomaly of the thermostat.

In a case of a cooling apparatus in which the detection value of the intake-air temperature sensor is adopted as the external air temperature, and the reference temperature is estimated based on that detection value, the same problem mentioned above occurs.

SUMMARY OF THE INVENTION

An object of the present invention is to provide a cooling apparatus for an internal combustion engine capable of improving detection accuracy of the anomaly of a thermostat.

According to a first aspect of the present invention, the cooling apparatus for the internal combustion engine is provided, which includes a thermostat that adjusts a feed rate of coolant to a radiator, detecting means that detects the temperature of the coolant, estimating means that estimates a reference temperature equivalent to the temperature of the coolant at least based on a detection value of an intake-air temperature sensor, and diagnosis means that sets the temperature of the coolant detected through the detecting means to a detection temperature and diagnoses an operating state of the thermostat by comparing the detection temperature and the reference temperature when a predetermined diagnosis condition is established. In the cooling apparatus for the internal combustion engine, a state in which the difference between the detection value of the intake-air temperature sensor and the external air temperature is equal to or greater than an upper limit value is set to a specific state. When the period of the specific state is equal to or longer than an upper limit period before the establishment of the diagnosis condition, the diagnosis of the operating state is prohibited.

According to a second aspect of the present invention, the cooling apparatus for the internal combustion engine is provided, which includes a thermostat that adjusts a feed rate of coolant to a radiator, detecting means that detects the temperature of the coolant, estimating means that estimates a reference temperature equivalent to the temperature of the coolant at least based on a detection value of an intake-air temperature sensor, and diagnosis means that sets the temperature of the coolant detected through the detecting means to a detection temperature and diagnoses an operating state of the thermostat by comparing the detection temperature and the reference temperature when a predetermined diagnosis condition is established. In the cooling apparatus for the internal combustion engine, a state in which the driving speed of a vehicle is less than a reference speed is set to a specific driving state. When a ratio of the time of the specific driving state to the time from the starting of the internal combustion engine until the establishment of the diagnosis condition is equal to or greater than a predetermined determination value, the diagnosis of the operating state is prohibited.

According to a third aspect of the present invention, the cooling apparatus for the internal combustion engine is provided, which includes a thermostat that adjusts a feed rate of coolant to a radiator, detecting means that detects the temperature of the coolant, estimating means that estimates a reference temperature equivalent to the temperature of the coolant at least based on a detection value of an intake-air temperature sensor, and diagnosis means that sets the temperature of the coolant detected through the detection means to a detection temperature and diagnoses an operating state of the thermostat by comparing the detection temperature and the reference temperature when a predetermined diagnosis condition is established. In the cooling apparatus for the internal combustion engine, when the integrated value of the intake amount drawn into the internal combustion engine from the starting of the internal combustion engine until the establishment of the diagnosis condition is less than a predetermined determination value, the diagnosis of the operating state is prohibited.

According to a fourth aspect of the present invention, the cooling apparatus for the internal combustion engine is provided, which includes a thermostat that adjusts a feed rate of coolant to a radiator, detecting means that detects the temperature of the coolant, estimating means that estimates a reference temperature equivalent to the temperature of the coolant at least based on a detection value of an intake-air temperature sensor, and diagnosis means that sets the temperature of the coolant detected through the detection means to a detection temperature, and diagnoses the operating state of the thermostat by comparing the detection temperature with the reference temperature when a predetermined diagnosis condition is established. In the cooling apparatus for the internal combustion engine, a variation of the reference temperature in the period from the starting of the internal combustion engine until the establishment of the diagnosis condition is set to a first variation. In the period from the starting of the internal combustion engine until the establishment of the diagnosis condition, when the variation of the reference temperature at the time when the driving speed of the vehicle is less than the reference speed is set to a second variation. When a ratio of the second variation to a first variation is equal to or greater than a predetermined determination value, the diagnosis of the operating state is prohibited.

According to a fifth aspect of the present invention, the cooling apparatus for the internal combustion engine is provided, which includes a thermostat that adjusts a feed rate of coolant to a radiator, detecting means that detects the temperature of the coolant, estimating means that estimates a reference temperature equivalent to the temperature of the coolant at least based on a detection value of an intake-air temperature sensor, and diagnosis means that sets the temperature of the coolant detected through the detection means to a detection temperature and diagnoses the operating state of the thermostat by comparing the detection temperature and the reference temperature when a predetermined diagnosis condition is established. In the cooling apparatus for the internal combustion engine, in the period from the starting of the internal combustion engine until the establishment of the diagnosis condition, a variation of the reference temperature at the time when the driving speed of the vehicle is equal to or greater than the reference speed is set to the first variation. In the period from the starting of the internal combustion engine until the establishment of the diagnosis condition, a variation of the reference temperature at the time when the driving speed of the vehicle is less than the reference speed is set to the second variation. When a ratio of the second variation to the first variation is equal to or greater than the predetermined determination value, the diagnosis of the operating state is prohibited.

According to a sixth aspect of the present invention, the cooling apparatus for the internal combustion engine is provided, which includes a thermostat that adjusts a feed rate of coolant to a radiator, detecting means that detects the temperature of the coolant, estimating means that estimates a reference temperature equivalent to the temperature of the coolant at least based on a detection value of an intake-air temperature sensor, and diagnosis means that sets the temperature of the coolant detected through the detection means to a detection temperature and diagnoses the operating state of the thermostat by comparing the detection temperature and the reference temperature when a predetermined diagnosis condition is established. The cooling apparatus for the internal combustion engine further includes correction means. A state in which a difference between the detection value of the intake-air temperature sensor and the external air temperature is equal to or greater than the upper limit value is set to a specific state. The correction means corrects the reference temperature when the period of the specific state is equal to or longer than the upper limit period before the establishment of the diagnosis condition.

According to a seventh aspect of the present invention, the cooling apparatus for the internal combustion engine is provided, which includes a thermostat that adjusts a feed rate of coolant to a radiator, detecting means that detects the temperature of the coolant, estimating means that estimates a reference temperature equivalent to the temperature of the coolant at least based on a detection value of an intake-air temperature sensor, and diagnosis means that sets the temperature of the coolant detected through the detection means to a detection temperature and diagnoses the operating state of the thermostat by comparing the detection temperature and the reference temperature when a predetermined diagnosis condition is established. The cooling apparatus for the internal combustion engine further includes the correction means. A state in which the driving speed of the vehicle is less than the reference speed is set to a specific driving state. The correction means the reference temperature when a ratio of the time of the specific driving state to the time from the starting of the internal combustion engine until the establishment of the diagnosis condition is equal to or greater than a predetermined determination value.

According to an eighth aspect of the present invention, the cooling apparatus for the internal combustion engine is provided, which includes a thermostat that adjusts a feed rate of coolant to a radiator, detecting means that detects the temperature of the coolant, estimating means that estimates a reference temperature equivalent to the temperature of the coolant at least based on a detection value of an intake-air temperature sensor, and diagnosis means that sets the temperature of the coolant detected through the detection means to a detection temperature and diagnoses the operating state of the thermostat by comparing the detection temperature and the reference temperature when a predetermined diagnosis condition is established. The cooling apparatus for the internal combustion engine further includes correction means that corrects the reference temperature when an integrated value of the intake amount from the starting of the internal combustion engine until the establishment of the diagnosis condition is less than a predetermined determination value.

According to a ninth aspect of the present invention, the cooling apparatus for the internal combustion engine is provided, which includes a thermostat that adjusts a feed rate of coolant to a radiator, detecting means that detects the temperature of the coolant, estimating means that estimates a reference temperature equivalent to the temperature of the coolant at least based on the detection value of an intake-air temperature sensor, and diagnosis means that sets the temperature of the coolant detected through the detection means to a detection temperature and diagnoses the operating state of the thermostat by comparing the detection temperature and the reference temperature when a predetermined diagnosis condition is established. The cooling apparatus for the internal combustion engine further includes the correction means that correct the reference temperature when the variation of the reference temperature in the period from the starting of the internal combustion engine until the establishment of the diagnosis condition is set to a first variation, when the variation of the reference temperature when the driving speed of the vehicle is less than the reference speed in the period from the starting of the internal combustion engine until the establishment of the diagnosis condition is set to a second variation, and when a ratio of the second variation to the first variation is equal to or greater than the predetermined determination value.

According to a tenth aspect of the present invention, the cooling apparatus for the internal combustion engine is provided, which includes a thermostat that adjusts a feed rate of coolant to a radiator, detecting means that detects the temperature of the coolant, estimating means that estimates a reference temperature equivalent to the temperature of the coolant at least based on a detection value of an intake-air temperature sensor, and diagnosis means that sets the temperature of the coolant detected through the detection means to a detection temperature and diagnoses the operating state of the thermostat by comparing the detection temperature and the reference temperature when a predetermined diagnosis condition is established. The cooling apparatus for the internal combustion engine further includes the correction means The variation of the reference temperature when the driving speed of the vehicle is equal to or greater than the reference speed in the period from the starting of the internal combustion engine until the establishment of the diagnosis condition is set to the first variation, and the variation of the reference temperature when the driving speed of the vehicle is less than the reference speed in the period from the starting of the internal combustion engine until the establishment of the diagnosis condition is set to the second variation. The correction means corrects the reference temperature when a ratio of the second variation to the first variation is equal to or greater than the predetermined determination value.

According to an eleventh aspect of the present invention, the cooling apparatus for the internal combustion engine is provided, which includes a thermostat that adjusts a feed rate of coolant to a radiator, detecting means that detects the temperature of the coolant, estimating means that estimates a reference temperature equivalent to the temperature of the coolant at least based on a detection value of an intake-air temperature sensor, and diagnosis means that sets the temperature of the coolant detected through the detection means to a detection temperature and diagnoses the operating state of the thermostat by comparing the detection temperature and the reference temperature when a predetermined diagnosis condition is established. The cooling apparatus for the internal combustion engine further includes the correction means that calculates the reference temperature based on a value obtained by correcting the detection value of the intake-air temperature sensor to reduce it.

DETAILED DESCRIPTION OF THE PREFERRED EMBODIMENTS

First Embodiment

A first embodiment of the present invention will be explained with reference to FIGS. 1 to 11.

The present invention is materialized in a cooling apparatus for an engine that directly injects a fuel into a combustion chamber.

<Structure of Vehicle>

Figure 1:
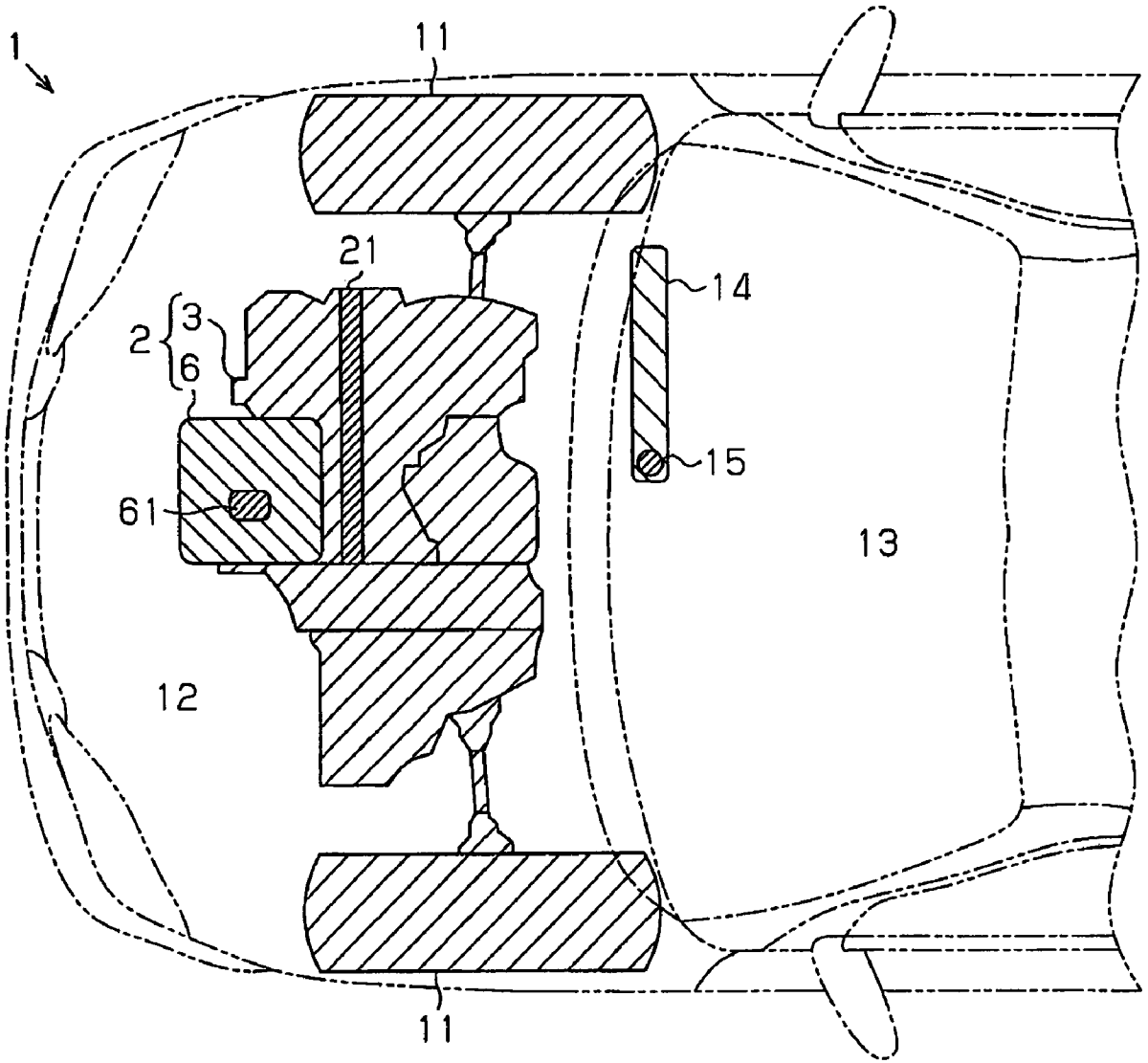
FIG. 1 is a partial schematic diagram of a vehicle mounted with a cooling apparatus according to a first embodiment.

As shown in FIG. 1, an engine 2 is provided with an engine main body 3 and a cooling apparatus 6. The engine 2 is mounted on an engine compartment 12 of a vehicle 1. The vehicle 1 drives through a rotation of wheels 11 by a crankshaft 21 of the engine 2. A cabin 13 of the vehicle 1 is provided with an indicator panel 14 that displays a state of the vehicle 1 or the engine 2.

The indicator panel 14 is provided with a warning lamp 15. The warning lamp 15 displays an anomaly of the operating state of a thermostat 61 that configures the cooling apparatus 6. The warning lamp 15 turns on when an anomaly is detected in the operating state of the thermostat 61.

<Structure of Engine>

Figure 2:
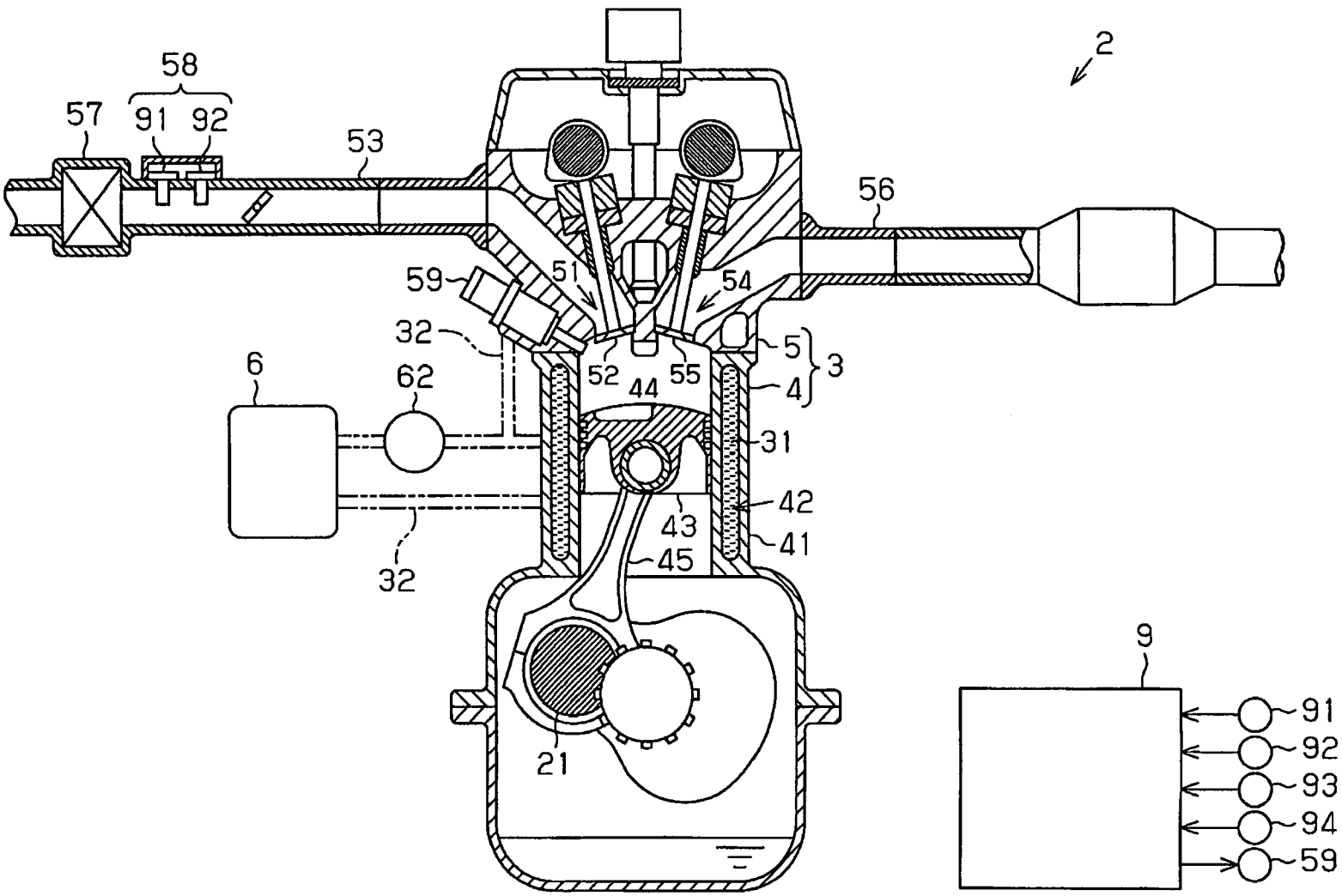
FIG. 2 is a cross-sectional view showing a whole configuration of an internal combustion engine.

As shown in FIG. 2, the engine main body 3 includes a cylinder block 4 and a cylinder head 5. The engine main body 3 has a passage (main body coolant passage 32) that feeds a coolant 31 to the cylinder block 4 and the cylinder head 5.

In the peripheral portion of the engine 2, a flow of the coolant 31 is formed through a water pump 62 of the cooling apparatus 6. The water pump 62 is driven through the crankshaft 21. The water pump 62 sucks and pressurizes the coolant 31 within the cooling apparatus 6, and after that, discharges the coolant 31 into the main body coolant passage 32.

The cylinder block 4 is provided with a plurality of cylinders 41. A water jacket 42 is formed in the peripheral portion of the cylinders 41. The water jacket 42 forms a part of the main body coolant passage 32.

Within each cylinder 41, a piston 43 is installed. A space surrounded by an inner peripheral surface of the cylinder 41, a top face of the piston 43, and the cylinder head 5 is formed as a combustion chamber 44. The piston 43 is coupled with the crankshaft 21 through a connecting rod 45.

The cylinder head 5 supports intake valves 52 that open and close intake ports 51 and exhaust valves 55 that open and close exhaust ports 54. The intake ports 51 are connected with an intake pipe 53 for allowing the outside air to circulate toward the combustion chambers 44.

The exhaust ports 54 are connected with an exhaust pipe 56 for allowing a gas flowing out from the combustion chambers 44 to circulate toward the outside. The intake pipe 53 is attached with an air cleaner 57. A sensor unit 58 is attached to a section that is downstream of the air cleaner 57 and close to the air cleaner 57.

The inside of a frame body of the sensor unit 58 is provided with an intake-air temperature sensor 91 and a hot-wire air flow meter 92. In the cylinder head 5, a place facing each combustion chamber 44 is provided with an injector 59 that directly injects a fuel into the combustion chamber 44.

An electronic control unit 9 includes a central processing unit that executes a calculation process relating to an engine control, a read-only-memory stored in advance with programs and maps necessary for the engine control, a random access memory temporarily storing calculation results and the like by the central processing unit, a back-up memory that stores data during an engine stop, an input port that inputs an external signal, and an output port that outputs an signal to the outside. The electronic control unit 9 also includes estimation means and diagnosis means.

The input port of the electronic control unit 9 is connected with an intake-air temperature sensor 91, an airflow meter 92, a coolant temperature sensor 93 (detection means), a vehicle speed sensor 94, and the like. An output port of the electronic control unit 9 is connected with a driving circuit of the injectors 59 and the like.

The intake-air temperature sensor 91 is provided in the intake pipe 53, and an electrical signal according to the air temperature (intake-air temperature THA) inside the intake pipe 53 is outputted. The output signal of the intake-air temperature sensor 91 is inputted to the electronic control unit 9, and after that, it is used for various types of controls as an intake-air temperature measurement value THAM.

The air flow meter 92 is attached to the intake pipe 53, and an electrical signal is outputted according to an air flow rate (intake-air flow rate GA) inside the intake pipe 53. The output signal of the air flow meter 92 is inputted to the electronic control unit 9, and after that, it is used for various types of controls as an intake-air flow rate measurement value GAM. The intake-air flow rate GA is equivalent to an air quantity (intake-air quantity) fed into the combustion chambers 44.

The coolant temperature sensor 93 is attached to the periphery of the cylinders 41, and an electrical signal according to the temperate (coolant temperature THW) of the coolant 31 inside the water jacket 42 is outputted. The output signal of the coolant temperature sensor 93 is inputted to the electronic control unit 9, and after that, it is used for various types of controls as the coolant temperature measurement value THWM.

The vehicle speed sensor 94 is attached to the vicinity of one of the wheels 11 of the vehicle 1, and an electrical signal according to the rotation speed (vehicle speed SPD) of the wheels 11 is outputted. The output signal of the vehicle speed sensor 94 is inputted to the electronic control unit 9, and after that, it is used for various types of controls as a vehicle speed measurement value SPDM.

The electronic control unit 9 executes various types of engine controls based on the detection data and the like of each sensor. For example, in a fuel injection control, the processing of adjusting a fuel injection quantity of the injector 59 according to the air flow rate GA is performed.

<Structure of Cooling Apparatus>

Figure 3:
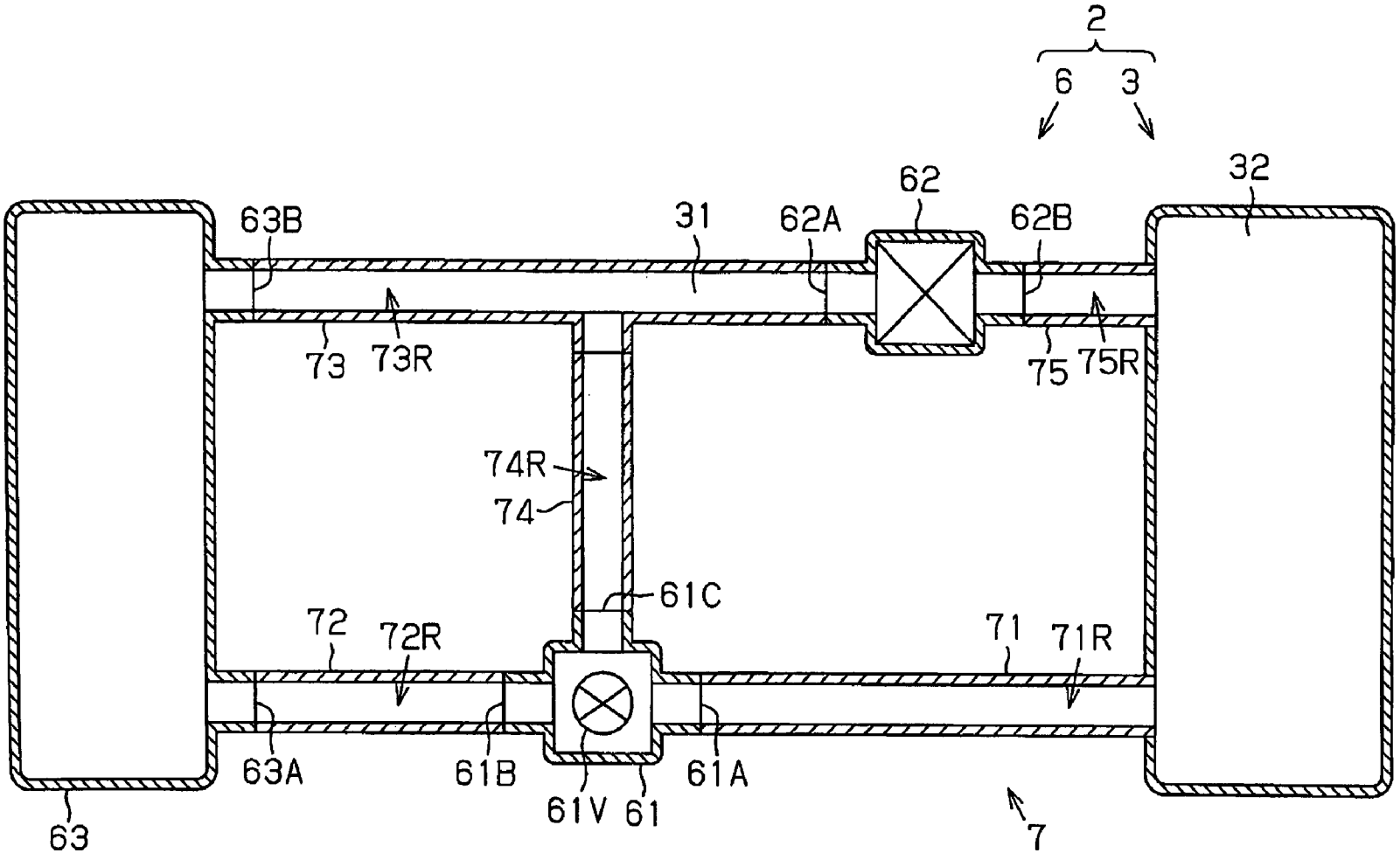
FIG. 3 is a schematic cross-sectional view showing a whole configuration of the cooling apparatus.

As shown in FIG. 3, the cooling apparatus 6 includes a thermostat 61, a water pump 62, and a radiator 63. The thermostat 61 changes a distribution route of the coolant 31 flowed into the interior through a coolant inlet 61A by a thermostat valve 61V. As an outlet of the coolant 31, a first coolant outlet 61B and a second coolant outlet 61C are provided.

The first coolant outlet 61B is opened or closed according to the opening and closing state of the thermostat valve 61V.

The second coolant outlet 61C is always opened regardless of the opening and closing state of the thermostat valve 61V.

The thermostat 61 has the thermostat valve 61V opened when the temperature of the coolant 31 is equal to or greater than the opened valve temperature THWT, thereby the first coolant outlet 61B is opened. On the other hand, when the temperature of the coolant 31 is less than the opened valve temperature THWT, the thermostat valve 61V is closed, thereby the first coolant outlet 61B is closed.

A heat exchange is performed by the radiator 63 between the coolant 31 flowed into the interior through the coolant inlet 63A and the outside air. The coolant 31 applied with the heat exchange by the radiator 63 is flowed back to the engine main body 3 through the coolant outlet 63B.

The engine main body 3 and the cooling apparatus 6 are connected through a coolant feed pipe 7 as follows.

[A] The main body coolant passage 32 of the engine main body 3 and the coolant inlet 61A of the thermostat 61 are connected by a first coolant feed pipe 71. The coolant 31 flowed out from the main body coolant passage 32 flows into the thermostat 61 through a passage (first coolant passage 71R) inside the first coolant feed pipe 71.

[B] The first coolant outlet 61B of the thermostat 61 and the coolant inlet 63A of the radiator 63 are connected by a second coolant feed pipe 72. The coolant 31 flowed out from the first coolant outlet 61B is fed to the radiator 63 through a passage (second coolant passage 72R) inside the second coolant feed pipe 72.

[C] The coolant outlet 63B of the radiator 63 and a suction port 62A of the water pump 62 are connected by a third coolant feed pipe 73. The coolant 31 flowed out from the coolant outlet 63B is drawn into the water pump 62 through a passage (third coolant passage 73R) inside the third coolant feed pipe 73.

[D] The second coolant outlet 61C of the thermostat 61 and the third coolant feed pipe 73 are connected by a fourth coolant feed pipe 74. The coolant 31 flowed out from the second coolant outlet 61C is drawn into the water pump 62 through a passage (fourth coolant passage 74R) inside the fourth coolant feed pipe 74.

[E] A discharge port 62B of the water pump 62 and the main body coolant passage 32 of the engine main body 3 are connected by a fifth coolant feed pipe 75. The coolant 31 discharged from the water pump 62 is fed to the engine main body 3 through a passage (fifth coolant passage 75R) inside the fifth coolant feed pipe 75.

The main body coolant passage 32 and the first to fifth coolant passages 71R to 75R form a coolant circuit for allowing the coolant 31 to circulate between the engine main body 3 and the cooling apparatus 6.

The coolant circuit includes the following first circuit and second circuit.

(A) The first circuit includes the main body coolant passage 32, the first coolant passage 71R, the second coolant passage 72R, the third coolant passage 73R, and the fifth coolant passage 75R. In the first circuit, the coolant 31 circulates between the engine main body 3 and the cooling apparatus 6 through the radiator 63.

(B) The second circuit includes the main body coolant passage 32, the first coolant passage 71R, the fourth coolant passage 74R, the third coolant passage 73R, and the fifth coolant passage 75R. In the second circuit, the coolant 31 circulates between the engine main body 3 and the cooling apparatus 6 without using the radiator 63.

<Circulation Pattern of Coolant>

Figure 4:
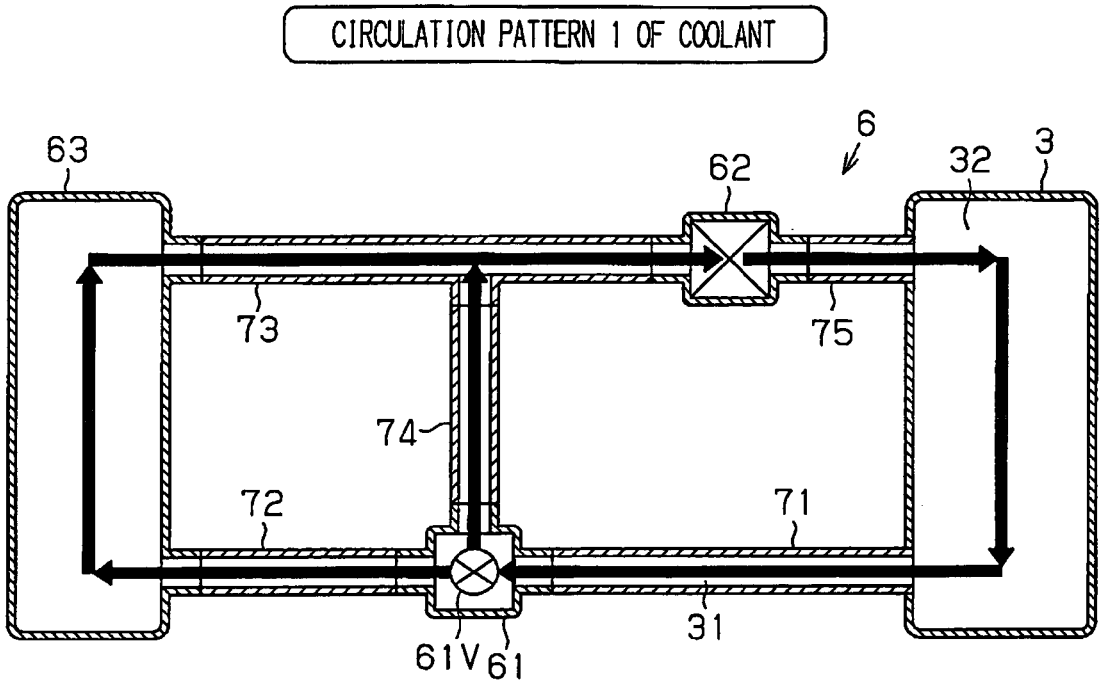
FIG. 4 is a sectional schematic illustration showing one example of the circulation pattern of a coolant.
Figure 5:
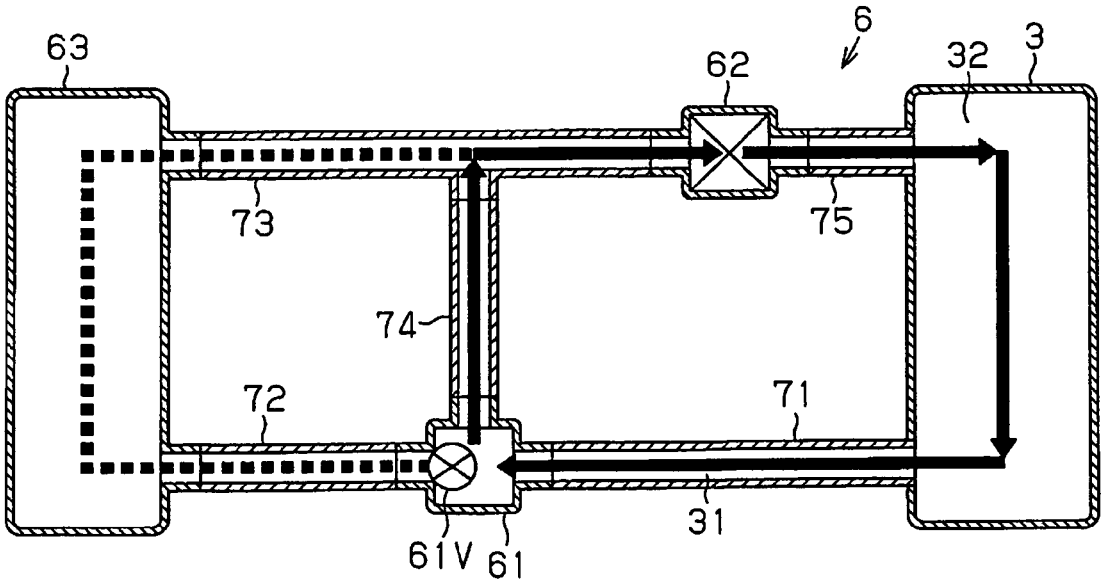
FIG. 5 is a cross-sectional schematic view showing one example of the circulation pattern of the coolant.

Referring to FIGS. 4 and 5, circulation patterns of the coolant 31 will be explained. In FIGS. 4 and 5, a solid line shows a passage formed with a flow of the coolant, and a broken line shows a passage not formed with a flow of the coolant.

[1] Circulation Pattern 1 of Coolant

As shown in FIG. 4, when the temperature of the coolant 31 is equal to or greater than the opened valve temperature THWT, the thermostat valve 61V is opened. Hence, the first circuit and the second circuit of the coolant circuit are put into an opened state, and the coolant 31 circulates through the first circuit and the second circuit.

[2] Circulation Pattern 2 of Coolant

As shown in FIG. 5, when the temperature of the coolant 31 is below the opened valve temperature THWT, the thermostat valve 61V is closed. Hence, the first circuit of the coolant circuit is closed, while the second coolant circuit is put into an opened state, and the coolant 31 circulates through the second circuit only.

<Malfunction of Thermostat>

In the thermostat 61, a phenomenon (stuck-open valve) often occurs in which the thermostat valve 61V is in an opened state and yet does not operate. In a state in which the stuck-open valve occurs, since the first circuit is held in an opened state regardless of the temperature of the coolant 31, the coolant 31 always circulates through the radiator 63. Hence, when the stuck-open valve occurs, the temperature of the coolant 31 is hard to rise as compared with the case where no anomaly of the thermostat 61 occurs. Hence, for example, the temperature of the coolant 31 is extremely lowered, thereby causing a possibility of inviting deterioration of an emission and the like.

Hence, in the cooling apparatus 6 of the present embodiment, an operating state of the thermostat 61 is diagnosed during the operation of the engine 2. When the stuck-open valve of the thermostat 61 is detected, a warning lamp 15 is turned on, thereby allowing a driver to recognize an anomaly of the thermostat 61. A state in which the stuck-open valve occurs in the thermostat 61 is taken as an abnormal state, and a state in which the stuck-open valve does not occur in the thermostat 61 is taken as a normal state.

<Anomaly Diagnosis Method of Thermostat>

Figure 6:
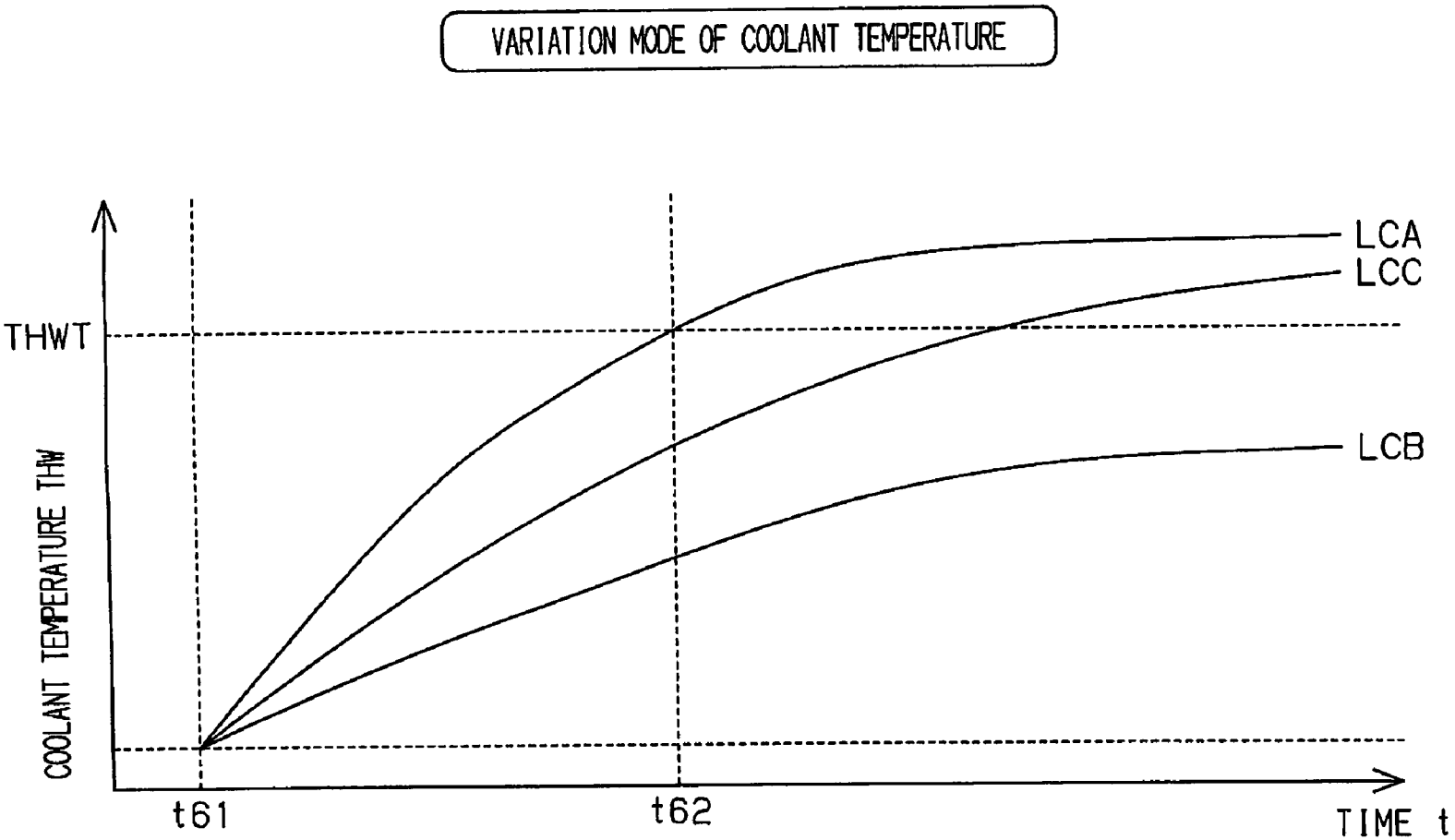
FIG. 6 is a graph showing one example of the temperature change of the coolant.
Figure 7:
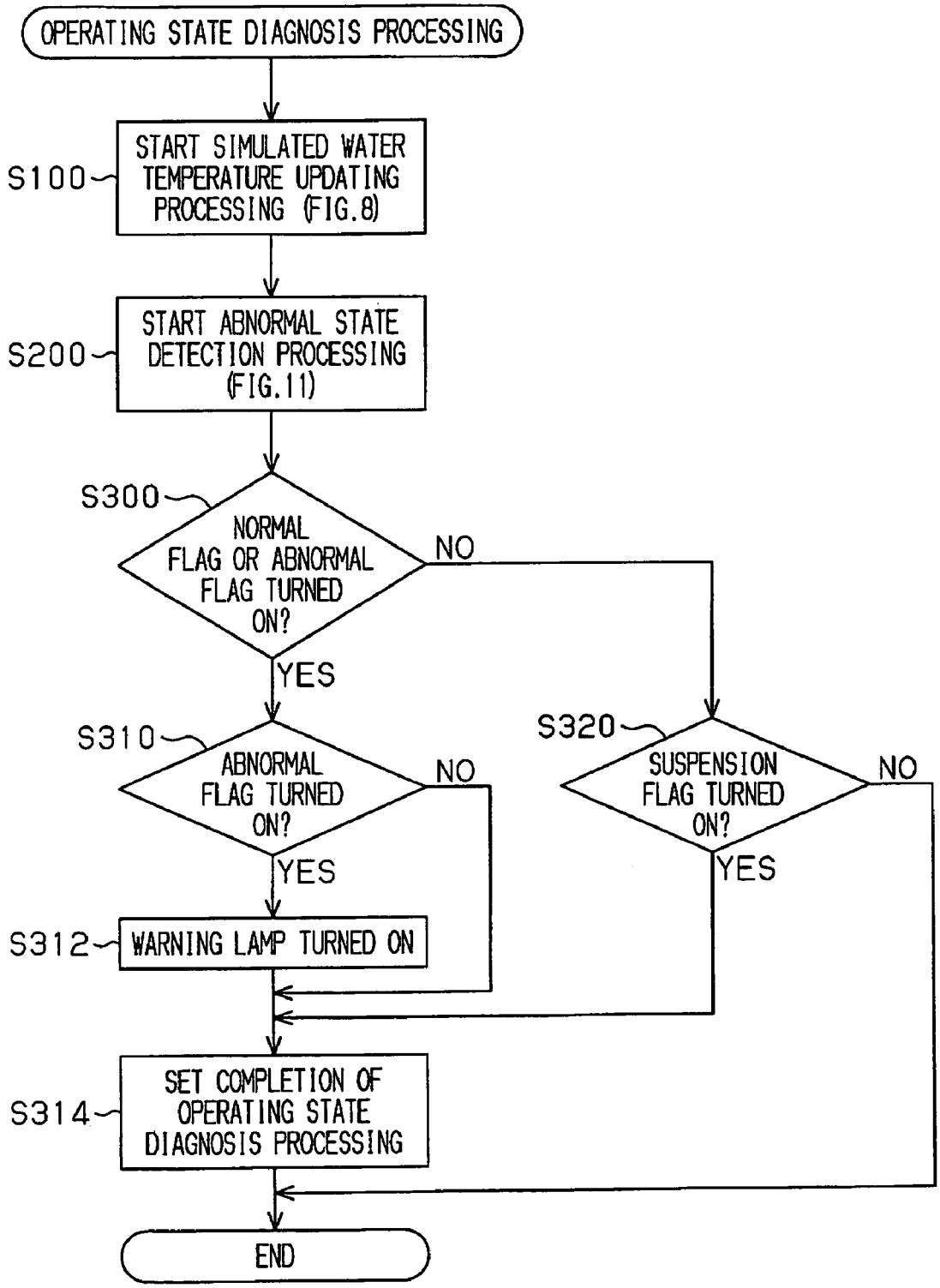
FIG. 7 is a flowchart showing an operating state diagnosis processing.

In FIG. 6 is shown a change of the temperature of the coolant 31 at the normal state and the abnormal state of the thermostat 61. Points in time t in FIG. 6 are shown below.

Time t61: when the operation of the engine 2 is started.

Time t62: the temperature of the coolant 31 at the normal state of the thermostat 61 reaches the opened valve temperature THWT.

At the abnormal state of the thermostat 61, since the coolant 31 always circulates through the radiator 63, even when the temperature of the coolant 31 timely reaches the opened valve temperature THWT at the normal state of the thermostat 61, the temperature of the coolant 31 shows a temperature lower than the opened value temperature THWT.

In the present embodiment, by paying attention to a difference of the temperature change of the coolant 31, the anomaly of the thermostat 61 is detected.

(A) On the assumption that the operating state of the thermostat 61 is normal, a simulation of the temperature change of the coolant 31 is performed based on the parameter affecting the temperature of the coolant 31. Here, the simulated temperature of the coolant 31 is taken as a coolant temperature simulated value THWE.

(B) When the diagnosis condition is established, the coolant temperature simulated value THWE and the actual temperature (coolant temperature THW detected through the coolant temperature sensor 93) of the coolant 31 are compared, thereby to diagnose the operating state of the thermostat 61. When the degree of the temperature rise of the coolant temperature simulated value THWE is greater than the degree of the temperature rise of the coolant temperature measurement value THWM, it is determined that the anomaly of the thermostat 61 occurs.

<Calculation Method of Coolant Temperature Simulated Value>

During the operation of the engine 2, the updating of the coolant temperature simulated value THWE is performed.

[1] A variation (simulated water temperature variation ΔTHWE) of the coolant temperature simulated value THWE, that is, a value equivalent to the temperature variation of the coolant 31 at the normal state of the thermostat 61 is calculated every predetermined number of calculation cycles.

[2] The simulated temperature variation ΔTHWE is reflected in the coolant temperature simulated value THWE, so that the coolant temperature simulated value THWE is updated according to the operating state.

<Calculation Method of Simulated Water Temperature Variation>

As parameters affecting the temperature change of the coolant 31, each of the following parameters (A) to (C) is used. By applying in advance a relationship between each parameter and the simulated water temperature variation ΔTHWE, an appropriate simulated water temperature variation ΔTHWE is calculated according to the driving state of the vehicle 1 and the operating state of the engine 2.

(A) Engine Load: In proportion to an increase of a load of the engine 2 (engine load LE), a calorific power accompanied with the combustion of fuel increases, and therefore, the temperature of the coolant 31 rises high. A relationship between the engine load LE and the simulated water temperature variation ΔTHWE is applied in advance, thereby performing the calculation of the simulated water temperature variation ΔTHWE. An intake amount GAP, that is, a ratio between an intake-air flow rate measurement value GAM and the maximum intake-air flow rate GAmax (the maximum intake-air flow rate GA obtained in the operating state at that time) is used as the engine load LE.

(B) Driving speed of Vehicle: In proportion to an increase of the vehicle speed SPD, since the heat exchange of the coolant 31 at the radiator 63 is expedited, the temperature of the coolant 31 is hard to rise. A relationship between the vehicle speed SPD and the simulated water temperature variation ΔTHWE is applied in advance, thereby performing the calculation of the simulated water temperature variation ΔTHWE based on this relationship.

(C) External Air Temperature Difference: In proportion to an increase of a temperature difference between the coolant 31 and the external air (external air temperature difference DfTHWA), since the heat dissipation of the coolant 31 is expedited, the temperature of the coolant 31 is hard to rise. A relationship between the external air temperature difference DfTHWA and the simulated water temperature variation ΔTHWE is applied in advance, thereby performing the calculation of the simulated water temperature variation ΔTHWE.

In reality, instead of directly detecting the external air temperature, the external air temperature is grasped through an intake-air temperature measurement value THAM. In general, the minimum intake-air temperature measurement value THAMmin (the minimum value from among the intake-air temperature measurement values THAM obtained from the starting time of the engine 2 to the present time) shows a value closest to the external air temperature. Hence, the minimum intake-air temperature measurement value THAMmin is used as a value equivalent to the external air temperature. A value (intake-air temperature difference DfTHWB) subtracting the minimum intake-air temperature measurement value THAMmin from the coolant temperature simulated value THWE is used as the external air temperature difference DfTHWA.

<Operating State Diagnosis Processing>

An operating state diagnosis processing is executed in order to diagnose the operating state of the thermostat 61. The operating state diagnosis processing is repeatedly executed every predetermined number of calculation cycles through the electronic control unit 9.

Referring to FIGS. 7 to 11, a detailed processing procedure of the operating state diagnosis processing will be explained.

At step S100, a simulated water temperature updating processing (FIG. 8) that updates the coolant temperature simulated value THWE is started. After the completion of the simulated water temperature updating processing, the procedure proceeds to the processing of step S200.

At step S200, an abnormal state detection processing (FIG. 11) for performing the detection of the anomaly of the thermostat 61 is started. After the termination of the abnormal state detection processing, the procedure proceeds to step S300.

At step S300, it is determined whether or not the diagnosis of the operating state of the thermostat 61 is executed. That is, it is determined whether or not either one of a flag (abnormal diagnosis flag FA) showing that the operating state of the thermostat 61 is abnormal or a flag (normal diagnosis flag FB) showing that the operating state of the thermostat 61 is normal is turned on.

When either one of the flags is turned on, the procedure proceeds to the processing of step S310.

When either one of the flags is not turned on, the procedure proceeds to the processing of step S320.

At step S310, it is determined whether or not an abnormal diagnosis flag FA is turned on.

When the abnormal diagnosis flag FA is turned on, the procedure proceeds to the processing of step S312.

When the normal diagnosis flag FB is turned on, the procedure proceeds to step S314.

At step S312, the warning lamp 15 is turned on.

At step S314, the completion of the operating state diagnosis processing is set. As a result, the processing of step S314 is completed, and the operating state diagnosis processing is completed.

At step S320, it is determined whether or not the diagnosis of the operating state of the thermostat 61 is suspended. That is, with respect to the diagnosis of the operating state of the thermostat 61, it is determined whether or not a flag (diagnosis suspension flag FC) showing the determination of suspending the execution thereof is turned on.

When the diagnosis suspension flag FC is turned on, the procedure proceeds to the processing of step S314.

When the diagnosis suspension flag FC is turned off, the present processing is temporarily terminated.

<Simulated Water Temperature Updating Processing>

Figure 8:
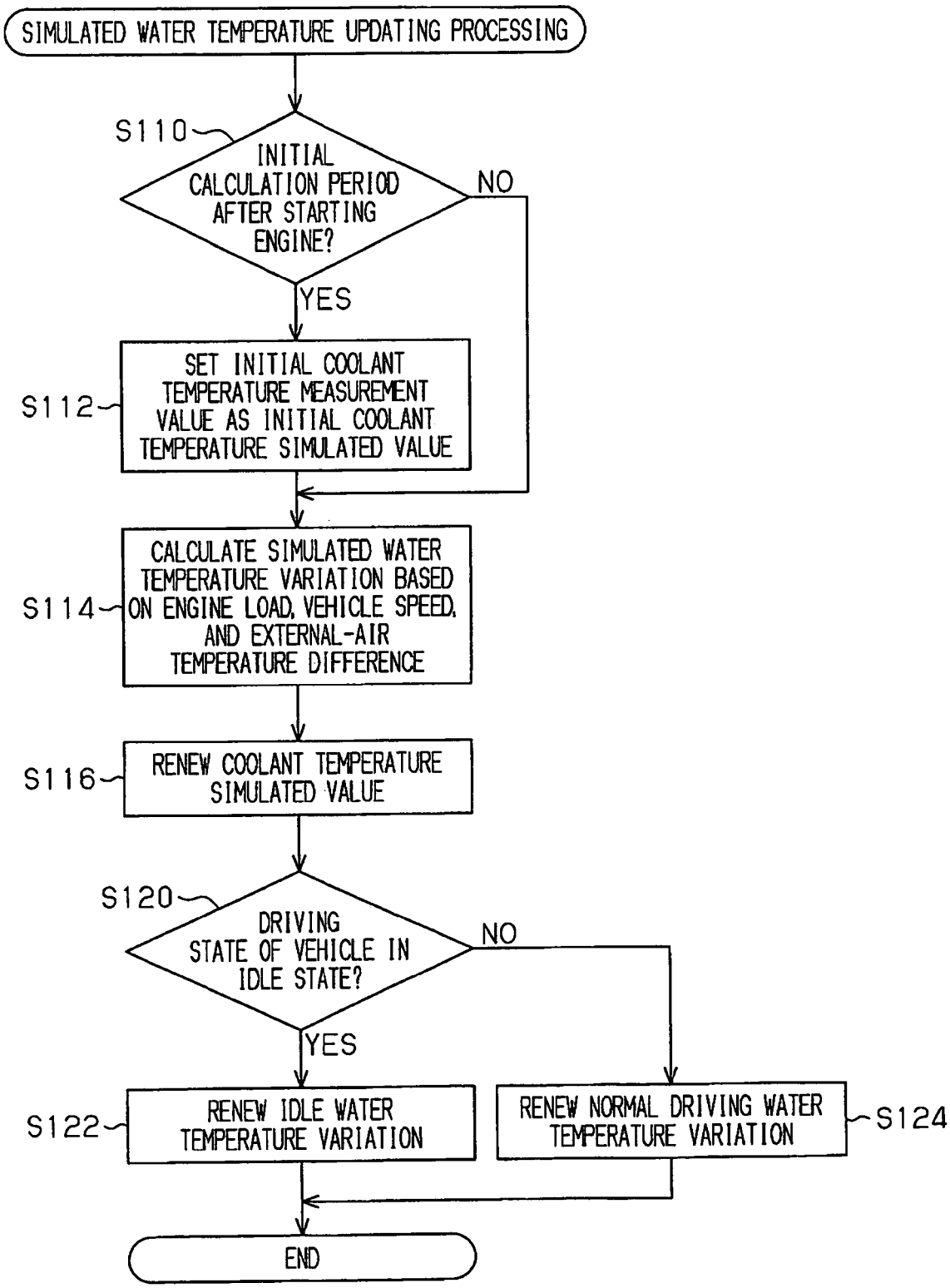
FIG. 8 is a flowchart showing a simulated water temperature updating processing.
Figure 9:
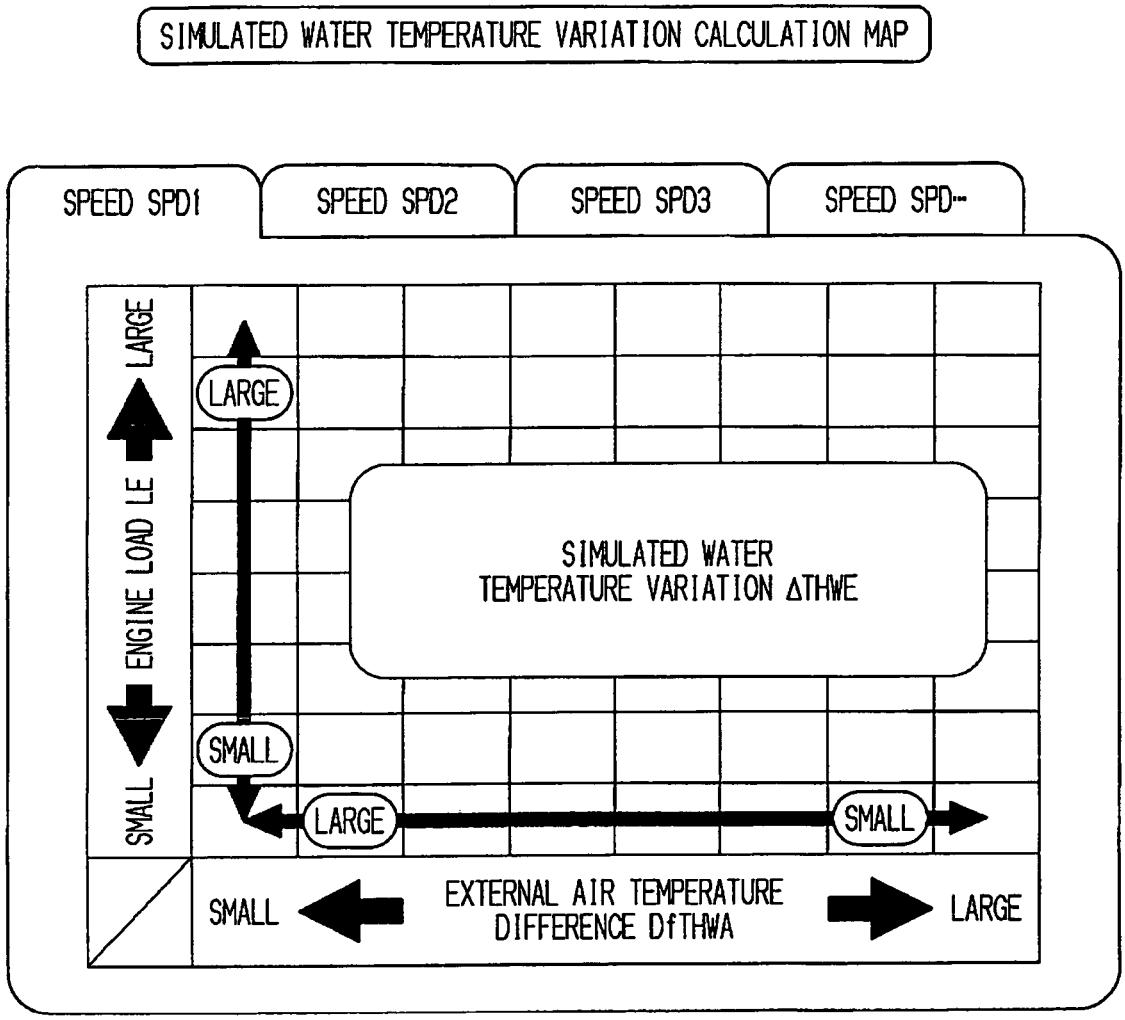
FIG. 9 is a simulated water temperature variation calculation map used in the simulated water temperature updating processing.
Figure 10:
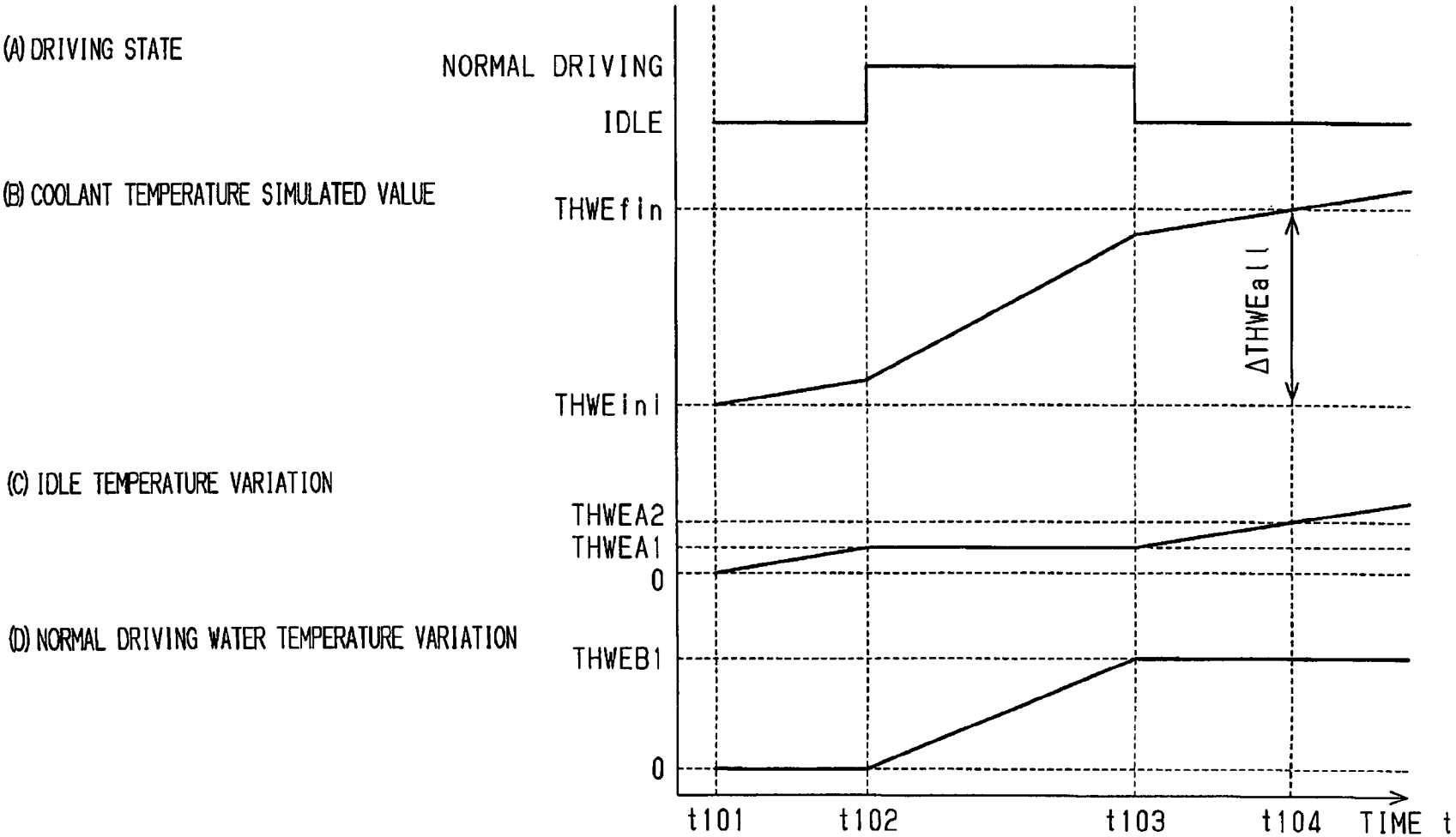
FIG. 10 is a timing chart showing an idle water temperature variation in the simulated water temperature updating processing and one example of a calculation mode of a normal driving water temperature variation.

Referring to FIGS. 8 to 10, the processing procedure of a simulated water temperature updating processing will be explained.

At step S110, it is determined whether or not the current calculation cycle is the first calculation cycle after the starting of the engine 2.

When it is the first calculation cycle, the procedure proceeds to the processing of step S112.

When it is not the first calculation cycle, the procedure proceeds to the processing of step S114.

At step S112, an initial value (initial coolant temperature measurement value THWMini) of the coolant temperature measurement value THWM is set as an initial value (initial coolant temperature simulated value THWEini) of the coolant temperature simulated value THWE.

At step S114, the simulated temperature variation ΔTHWE is calcualated based on the engine load LE, the vehicle speed SPD, and the external air temperature difference DfTHWA. Specifically, the calculation of the simulated temperature variation ΔTHWE is performed through the processings of the next step S114-1 and step S114-2.

At step S114-1, each parameter used in the calculation of the simulated water temperature variation ΔTHWE is set by each mode shown as follows.

(a) The intake amount GAP calculated from the intake-air flow rate measurement value GAM and the maximum intake-air flow rate GAmax of the current calculation cycle is set as the engine load LE.

(b) The vehicle speed measurement value SPDM of the current calculation cycle is set as the vehicle speed SPD.

(c) The intake-air temperature difference DfTHWB calculated from the coolant temperature simulated value THWE and the minimum intake-air temperature measurement value THAMmin of the current calculation cycle are set as the external air temperature difference DfTHWA.

At step S114-2, the simulated water temperature variation ΔTHWE is calculated by applying each parameter of step S114-1 to the map (simulated water temperature variation calculation map (FIG. 9)) set with a relationship between the engine load LE, the vehicle speed SPD, the external air temperature difference DfTHWA, and the simulated water temperature variation ΔTHWE. Here, as the simulated water temperature variation calculation map, a two-dimensional map set with a relationship among the engine load LE, the external air temperature difference DfTHWA, and the simulated water temperature variation ΔTHWE is provided for each predetermined vehicle speed SPD.

The simulated water temperature variation calculation map (FIG. 9) is a map mapped with a relationship among the engine load LE, the external air temperature difference DfTHWA, the vehicle speed SPD, and the simulated water temperature variation ΔTHWE through the tests and the like. A relationship between each parameter and the simulated water temperature variation ΔTHWE is set as follows.

(a) The coolant temperature THW basically rises in proportion as the engine load LE changes to a higher load. In conformity with the changing tendency of the coolant temperature THW, a relationship between the engine load LE and the simulated water temperature variation ΔTHWE is set.

(b) The coolant temperature THW basically falls in proportion as the external air temperature difference DfTHWA increases. In the map, in conformity with the changing tendency of the coolant temperature THW, a relationship between the external air temperature difference DfTHWA and the simulated water temperature variation ΔTHWE is set.

(c) The coolant temperature THW basically falls in proportion as the vehicle speed SPD changes to a higher speed. In conformity with the changing tendency of the coolant temperature THW, a relationship between the vehicle speed SPD and the simulated water temperature variation ΔTHWE is set.

At step S116, the coolant temperature simulated value THWE is updated by allowing the simulated water temperature variation ΔTHWE to be reflected in the present coolant temperature simulated value THWE (coolant temperature simulated value THWE calculated in the previous calculation cycle). That is, the calculation of the coolant temperature simulated value THWE is performed through Expression 11.

$$THWE \leftarrow THWE + \Delta THWE \quad \text{[Expression 11]}$$

As shown in FIG. 6, the simulated water temperature variation ΔTHWE is adapted so that a curved line (simulated water temperature curved line LCC) tracing the change of the coolant temperature simulated value THWE in relation to time is located between a curved line (normal water temperature curved line LCA) tracing the change of the actual coolant temperature THW at the normal state of the thermostat 61 and a curved line (abnormal water temperature curved line LCB) tracing the change of the actual coolant temperature THW at the abnormal state of the thermostat 61. Hence, the coolant temperature simulated value THWE calculated through Expression 11 is different from the actual coolant temperature THW at the normal state of the thermostat 61.

At step S120, it is determined whether or not the driving state of the vehicle 1 is an idle state. Here, when idle operating conditions (the following conditions (a) and (b)) are established, it is determined that the driving state is an idle state. On the other hand, when the idle operating conditions are not established, it is determined that the driving state is not an idle state (normal driving state). As the idle operating conditions, the conditions other than the following (a) and (b) can be set.

(a) The depression amount of the accelerator pedal is 0 (accelerator pedal is released).

(b) A vehicle measurement value SPDM is less than a determination value (the state of the vehicle 1 is a stopping or equivalent state).

Through the determination processing of step S120, the following processings are performed.

When the driving state is an idle state, the procedure proceeds to the processing of step S122.

When the driving state is a normal driving state, the procedure proceeds to the processing of step S124.

At step S122, an integrated value (idle water temperature variation ΔTHWEA) of the simulated water temperature variation ΔTHWE in an idle state is calculated. That is, the calculation of an idle water temperature variation ΔTHWEA is performed through Expression 12.

$$\Delta THWEA \leftarrow \Delta THWEA + \Delta THWE \quad \text{[Expression 12]}$$

In Expression 12, the ΔTHWEA of the right side indicates the most recent idle water temperature variation ΔTHWEA before the current calculation cycle.

The ΔTHWE indicates the simulated water temperature variation ΔTHWE calculated through the processing of step S114 in the current calculation cycle.

The idle water temperature variation ΔTHWEA is updated only when in an idle state through the determination processing of step S120. The initial value of the idle water temperature variation ΔTHWEA is set to 0.

At step S124, an integrated value (normal driving water temperature variation ΔTHWEB) of the simulated water temperature variation ΔTHWE in the normal driving state is calculated. That is, the calculation of the normal driving water temperature variation ΔTHWEB is performed through Expression 13.

$$\Delta THWEB \leftarrow \Delta THWEB + \Delta THWE \quad \text{[Expression 13]}$$

In Expression 13, ΔTHWEB of the right side indicates the most recent normal driving water temperature variation ΔTHWEB calculated before the current calculation cycle. The ΔTHWE indicates the simulated water temperature variation ΔTHWE calculated through the processing of step S114 in the current calculation cycle.

The normal driving water temperature variation ΔTHWEB is updated only when in the normal driving state through the determination processing of step S120. The initial value of the normal driving water temperature variation ΔTHWEB is set to 0.

Referring to FIG. 10, one example of an updating model of the idle water temperature variation ΔTHWEA and the normal driving water variation ΔTHWEB will be explained. Points in time t of FIG. 10 show the following timings, respectively.

Time t101: when the driving of the engine 2 is started.

Time t102: when the driving state of the vehicle 1 is changed from the idle state to the normal driving state.

Time t103: when the driving state of the vehicle 1 is changed from the normal driving state to the idle state.

Time t104: when a timing to diagnose the operating state reaches.

According to the driving state of the vehicle 1, the idle water temperature variation ΔTHWEA and the normal driving water temperature variation ΔTHWEB are changed as follows, respectively.

(A) Since the driving state is in an idle state during the period of the time t101 to the time t102, the idle water temperature variation ΔTHWEA increases from the initial value of 0 to the variation ΔTHWEA1. On the other hand, the normal driving water temperature variation ΔTHWEB is suspended in the initial value of 0.

(B) Since the driving state is the normal driving state during the period from the time t102 to the time t103, the normal driving water temperature variation ΔTHWEB increases from the initial value of 0 to the variation ΔTHWEB1. On the other hand, the idle water temperature variation ΔTHWEA is suspended in the variation ΔTHWEA1.

(C) Since the driving state is the idle state during the period from the time t103 to the time t104, the idle water temperature variation ΔTHWEA increases from the variation ΔTHWEA1 to the variation ΔTHWEA2. On the other hand, the normal driving water temperature variation ΔTHWEB is suspended in the variation ΔTHWEB1.

<Abnormal State Detection Processing>

Figure 11:
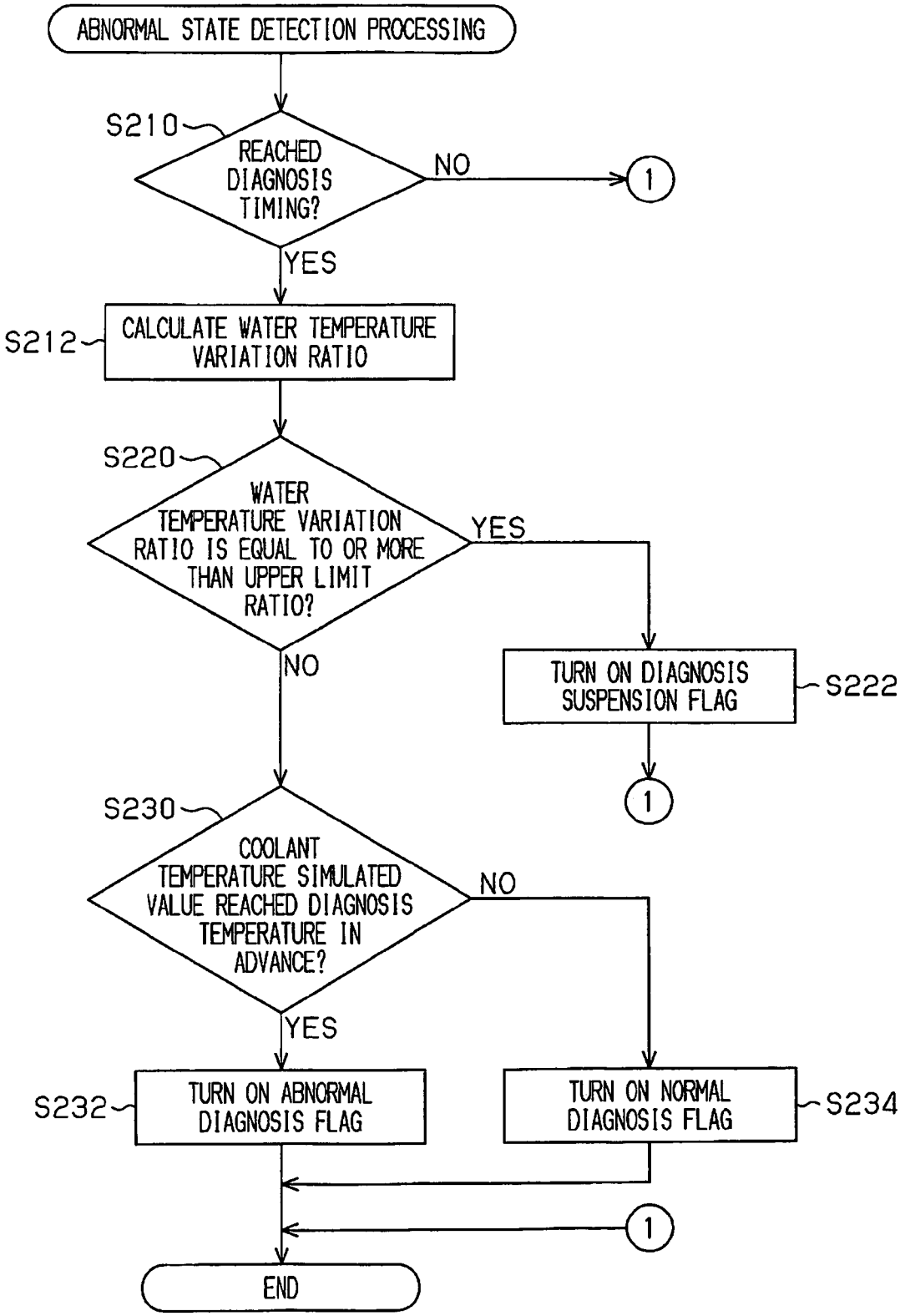
FIG. 11 is a flowchart showing an abnormal state detection processing.

Referring to FIG. 11, the processing procedure of an abnormal state detection processing will be explained.

At step S210, it is determined whether or not a timing to perform the diagnosis of the operating state of the thermostat 61 has come (whether or not the diagnosis condition is established). That is, it is determined whether or not either one of the coolant temperature measurement value THWM or the coolant temperature simulated value THWE reaches the diagnosis temperature THWD. Subsequently, the coolant temperature simulated value THWE in the diagnosis timing of the operating state is taken as the determined coolant temperature simulated value THWEfin.

A diagnosis temperature THWD is set in advance through the test and the like. Here, the standard opened valve temperature THWT (82° C. in general) of the thermostat 61 is added with the detection error and the like of the coolant temperature sensor 93, thereby setting the diagnosis temperature THWD. Specifically, the diagnosis temperature THWD is set slightly lower than the standard value of the opened valve temperature THWD (here at 75° C.). As a result, the diagnosis of the operating state is performed at the earliest estimated timing from among the timing when the normal thermostat is opened.

Through the decision processing of step S210, the following processing is performed.

When either of the coolant temperature measurement value THWM and the coolant temperature simulated value THWE reaches the diagnosis temperature THWD, the procedure proceeds to the processing of step S212.

When either of the coolant temperature measurement value THWM and the coolant temperature simulated value THWE does not reach the diagnosis temperature THWD, the present processing is temporarily terminated.

At step S212, a ratio of the idle water temperature variation ΔTHWEA (water temperature variation ratio ΔTHWEP) to the normal driving water temperature variation ΔTHWEB is calculated. Through Expression 14, the calculation of the water temperature variation ratio ΔTHWEP is performed.

$$\Delta THWEP \leftarrow \Delta THWEA / \Delta THWEB \quad \text{[Expression 14]}$$

In Expression 14, the ΔTHWEA shows the most recent idle water temperature variation ΔTHWEA calculated in the current calculation cycle or the previous calculation cycle. Similarly, the ΔTHWEB shows the most recent normal driving water temperature variation ΔTHWEB calculated in the current calculation cycle or the previous calculation cycle.

At step S220, it is determined whether or not the water temperature variation ratio ΔTHWEP is equal to or greater than an upper limit ratio XP. The upper limit ratio XP is a value for determining whether or not the diagnosis of the operating state of the thermostat 61 can be accurately performed.

The electronic control unit 9, through the determination processing of step S220, performs the following determination with respect to the diagnosis of the operating state.

(a) When the water temperature variation ratio ΔTHWEP is equal to or greater than the upper limit ratio XP, it is determined that the diagnosis of the operating state can be accurately performed, and the procedure proceeds to the processing of step S222.

(b) When the water temperature variation ratio ΔTHWEP is less than the upper limit ratio XP, it is determined that the diagnosis of the operating state cannot be accurately performed, and the procedure proceeds to the processing of step S230.

Here, the condition of the water temperature variation ratio ΔTHWEP being equal to or greater than the upper limit ratio XP is equivalent to the condition showing that the period in which the operating state has becomes a specific state before the establishment of the diagnosis condition (state in which difference between the detection value of the intake-air temperature sensor and the external air temperature is equal to or more than the upper limit value) is equal to or longer than the upper limit period.

Referring to FIG. 10, one example of a processing mode in the diagnosis timing of the operating state will be explained.

In the diagnosis timing at the time t104, based on the idle water temperature variation ΔTHWEA2 and the normal driving water temperature variation ΔTHWEB1, the water temperature variation ratio ΔTHWEP is calculated. Comparing the calculated water temperature variation ratio ΔTHWEP with the upper limit ratio XP, it is determined whether or not the diagnosis of the operating state of the thermostat 61 is executed.

The difference (simulated water temperature whole variation ΔTHWEall) between a determined coolant temperature simulated value THWEfin and an initial coolant temperature simulated value THWEini is equal to the sum of the idle water temperature variation ΔTHWEA and the normal driving water temperature variation ΔTHWEB. In the case of FIG. 10, the variation of the coolant temperature simulated value THWE in the period from the time t101 to the time t104 is equal to the sum of the idle water temperature variation ΔTHWEA2 and the normal driving water temperature variation ΔTHWEB1.

At step S222, the diagnosis suspension flag FC is turned on.

At step S230, it is determined whether or not the coolant temperature simulated value THWE reaches a diagnosis temperature THWD before the coolant temperature measurement value THWM.

When the coolant temperature simulated value THWE reaches the diagnosis temperature THWD in advance, the procedure proceeds to the processing of step S232.

When the coolant temperature measurement value THWM reaches the diagnosis temperature THWD in advance, the procedure proceeds to the processing of step S234.

At step S232, an abnormal diagnosis flag FA is turned on.

At step S234, the normal diagnosis flag FB is turned on. The flags turned on through the processings of steps S222, and S232 or S234 are initialized (flags are turned off) during the period from the termination of the operating state diagnosis processing by step S314 until the start of the next operating state diagnosis processing.

<On Comparison of Water Temperature Variation Ratio with Upper Limit Ratio>

In the operating state diagnosis processing, the water temperature variation ratio ΔTHWEP is calculated, and moreover, the water temperature variation ratio ΔTHWEP and the upper limit ratio XP are compared, thereby to determine whether or not the diagnosis of the operating state of the thermostat 61 is executed.

The reason why such determination is made will be explained as follows.

When the intake-air temperature sensor 91 receives the heat discharged from the engine 2 and the heat discharged from the air flow meter 92, the temperature of the sensor itself rises. In the present embodiment, since the intake-air temperature sensor 91 is provided inside the sensor unit 58 together with the air flow meter 92, the intake-air temperature sensor 91 is prone to receive the heat from the air flow meter 92.

As a result, the intake-air temperature measurement value THAM shows a value higher than the actual external air temperature, and at the same time, in proportion as the degree of the temperature rise of the intake-air temperature sensor 91 becomes large, the deviation between the intake-air temperature measurement value THAM and the external air temperature increases. Particularly, after the engine 2 is stopped, when the engine 2 is started again in a state not sufficiently cooled (a so-called restart at high temperature), since the measurement of the intake-air temperature THA is performed in a state in which the temperature of the intake-air temperature sensor 91 itself is high as compared with the normal engine start time (start time after the engine 2 is sufficiently cooled), the isolation between the intake-air temperature measurement value THAM and the external air temperature becomes remarkable.

In the operating state diagnosis processing, based on the intake-air temperature measurement value THAM, an equivalent value (intake-air temperature difference DfTHWB) of the external air temperature difference DfTHWA is calculated, and moreover, based on this equivalent value, the simulated water temperature variation ΔTHWE is calculated, and therefore, the problem shown below occurs. That is, the coolant temperature simulated value THWE is frequently updated based on the simulated water temperature variation ΔTHWE in which the actual external air temperature is not properly reflected. Therefore, a determined coolant temperature simulated value THWEfin is sharply deviated from the value (coolant temperature simulated value THWE calculated based on the actual external air temperature) that must be primarily set. Further, the intake-air temperature measurement value THAM shows a value higher than the external air temperature, so that a value exceeding the value that must be primarily calculated as the simulated water temperature variation ΔTHWE is calculated.

Hence, when the deviation between the intake-air temperature measurement value THAM and the external air temperature sharply increases, at the normal state of the thermostat 61 also, a rising ratio of the coolant temperature simulated value THWE exceeds a rising ratio of the actual coolant temperature THW. In this case, since the coolant temperature simulated value THWE reaches the diagnosis temperature THWD before the actual coolant temperature THW (coolant temperature measurement value THWM), it is diagnosed as being abnormal regardless of the fact that the operating state of the thermostat 61 is normal.

On the other hand, accompanied with the driving of the vehicle 1, through the driving wind fed to the inside of the engine compartment 12 and the air drawn into the intake pipe 53, the intake-air temperature sensor 91 is cooled. When the sensor is sufficiently cooled by the driving wind and the drawn air, the excessive deviation between the intake-air temperature measurement value THAM and the external air temperature can be avoided.

Consequently, in the period from the starting of the engine 2 until the diagnosis timing, when the normal driving of the vehicle 1 continues for a relatively long period of time, reliability of the determined coolant temperature simulated value THWEfin can be sufficiently secured. That is, the deviation between the calculated coolant temperature simulated value THWE and the primary coolant temperature simulated value THWE (coolant temperature simulated value THWE calculated based on the actual external air temperature) reaches a scale within permissible limits for the diagnosis of the operating state.

On the contrary, in the period from the starting of the engine 2 until the diagnosis timing, the driving wind is not fed to the inside of the engine compartment 12, and moreover, when the idle of the vehicle 1 continues for a relatively long period of time, reliability of the determined coolant temperature simulated value THWEfin cannot be sufficiently secured. That is, the deviation between the calculated coolant temperature simulated value THWE and the primary coolant temperature simulated value THWE (coolant temperature simulated value THWE calculated based on the actual external air temperature) reaches a scale out of permissible limits for the diagnosis of the operating state.

Hence, when a ratio of the normal driving water temperature variation ΔTHWEB to the idle water temperature variation ΔTHWEA is equal to or greater than the upper limit ratio XP, that is, when a ratio of the idle water temperature variation ΔTHWEA to a simulated water temperature whole variation ΔTHWEall is equal to or greater than the upper limit value, it is determined that the diagnosis of the operating state cannot be accurately performed.

The operating state diagnosis processing of the present embodiment compares the water variation ratio ΔTHWEP with the upper limit ratio XP, and selects the execution or suspension of the diagnosis of the operating state. As a result, the diagnosis of the operating state based on the determined coolant temperature simulated value THWEfin which does not sufficiently secure the reliability is not executed.

Advantages of the Embodiment

According to the first embodiment, the following advantage can be obtained.

(1) When the water temperature variation ratio ΔTHWEP is equal to or greater than the upper limit ratio XP, the diagnosis of the operating state of the thermostat 61 is suspended. As a result, an erroneous detection of the anomaly of the thermostat 61 can be controlled. Hence, the detection accuracy of the anomaly of the thermostat 61 can be improved.

Other Configurations of Embodiment

The first embodiment may be modifed, for example, as shown below.

In the first embodiment, when the water temperature variation ratio ΔTHWEP is equal to or greater than the upper limit ratio XP in the diagnosis timing, the diagnosis of the operating state is suspended. However, the embodiment may be changed, for example, to the modification 1 and modification 2 as shown below. In each of the following modifications, the electronic control unit 9 includes the correction means.

Modification 1: A correction to reduce the coolant temperature simulated value THWE (determined coolant temperature simulated value THWEfin) is performed. The coolant temperature simulated value THWE after the correction and the coolant temperature measurement value THWM are compared, thereby executing the diagnosis of the operating state.

Modification 2: In the modification 1, the correction degree for the coolant temperature simulated value THWE is changed according to the magnitude of the water temperature variation ratio ΔTHWEP. In this case, in proportion as the water temperature variation ratio ΔTHWEP increases, the correction value of the coolant temperature simulated value THWE is set large. That is, accompanied with the increase of the water temperature variation ratio ΔTHWEP, the coolant temperature simulated value THWE is corrected to a smaller value.

In the first embodiment, when the water temperature variation ratio ΔTHWEP is equal to or greater than the upper limit ratio XP, the diagnosis of the operating state is suspended. However, for example, the water temperature variation ratio ΔTHWEP is equal to or greater than the upper limit ratio XP, the coolant temperature simulated value THWE may be subtracted by a constant value, thereby continuing the updating of the coolant temperature simulated value THWE. In this case, since a chance of executing the diagnosis or suspending the determination can be obtained again, the diagnosis of the operating state can be executed according to the updating of the coolant temperature simulated value THWE after subtracting the coolant temperature simulated value THWE.

As explained in the first embodiment, the temperature of the intake-air temperature sensor 91 itself at the starting time of the engine 2 is different from the high temperature restarting time and the normal starting time of the engine 2. Hence, in consideration of such difference in temperatures, the upper limit ratio XP in the high temperature restarting time and the upper limit ratio XP in the normal starting time may be set to a different value. In this case, the upper limit ratio XP at the normal starting time is set to a value smaller than the upper limit ratio XP at the high temperature restarting time.

In the first embodiment, by comparing the water temperature variation ratio ΔTHWEP with the upper limit ratio XP, the execution or suspension of the diagnosis of the operating state is selected. However, the embodiment may be changed, for example, to the modification A to the modification F as mentioned below.

[1] On Modification A

As the modification A, the configurations of the following modification A1 to modification A3 can be applied. The modification A1 can be applied to the first embodiment, the modification A2 to the modification A1, and the modification A3 to the modification A2, respectively. In the modification A2 and the modification A3, the electronic control unit 9 includes the correction means.

Modification A1: Each processing of the first embodiment is changed as follows.

(A) In the processing of step S212, a ratio (idle variation ratio) of the idle water temperature variation ΔTHWEA to the simulated water temperature whole variation ΔTHWEall is calculated.

(B) In the processing of step S220, the idle variation ratio and the determination value are compared, thereby selecting the execution or suspension of the diagnosis. That is, when the idle variation ratio is equal to or greater than the determination value, the execution of the diagnosis is suspended (diagnosis suspension flag FC is turned on). On the other hand, when the idle variation ratio is less than the determination value, the execution of the diagnosis is permitted (procedure proceeds to step S230). In this case, the processing of step S124 can be omitted.

Modification A2: In the modification A1, when the idle variation ratio is equal to or more than the determination value, a correction to reduce the coolant temperature simulated value THWE (determined coolant temperature simulated value THWEfin) is performed. The coolant temperature simulated value THWE after the correction and the coolant temperature measurement value THWM are compared, thereby executing the diagnosis of the operating state.

Modification A3: In the modification A2, according to the volume of the idle variation ratio, the correction degree for the coolant temperature simulated value THWE is changed. In this case, in proportion as the idle variation ratio increases, a correction value of the coolant temperature simulated value THWE is set large. That is, accompanied with the increase of the idle variation ratio, the coolant temperature simulated value THWE is corrected to a smaller value.

In the modification A, the condition of the idle variation ratio being equal to or greater than the determination value is equivalent to the condition showing that the period in which the operating state becomes a specific state before the establishment of the diagnosis condition (state in which difference between the detection value of the intake-air temperature sensor and the external air temperature is equal to or more than the upper limit value) is equal to or more than the upper limit period.

[2] On Modification B

As the modification B, the following configurations of a modification B1 to a modification B3 can be applied. The modification B1 can be applied to the first embodiment, the modification B2 to the modification B1, and the modification B3 to the modification B2, respectively. In the modification B2 and the modification B3, the electronic control unit 9 includes the correction means.

Modification B1: Each processing of the first embodiment is changed as follows.

(A) In the processing of step S212, a ratio (normal driving ratio) of the normal driving water temperature variation ΔTHWEB occupied in the simulated water temperature whole variation ΔTHWEall is calculated.

(B) In the processing of step S220, the normal driving variation ratio and the determination value are compared, thereby selecting the execution or suspension of the diagnosis. That is, when the normal driving variation ratio is less than the determination value, the execution of the diagnosis is suspended (diagnosis suspension flag FC is turned on). On the other hand, when the normal driving variation ratio is equal to or greater than the determination value, the execution of the diagnosis is permitted (procedure proceeds to step S230). In this case, the processing of step S122 can be omitted.

Modification B2: In the modification B1, when the normal driving variation ratio is less than the determination value, the correction to reduce the coolant temperature simulated value THWE (determined coolant temperature simulated value THWEfin) is performed. The coolant temperature simulated value THWE after the correction and the coolant temperature measurement value THWM are compared, thereby executing the diagnosis of the operating state.

Modification B3: In the modification B2, the correction degree for the coolant temperature simulated value THWE is changed according to the magnitude of the normal driving variation ratio. In this case, in proportion as the normal driving variation ratio becomes small, the correction value of the coolant temperature simulated value THWE is set large. That is, accompanied with the decrease of the normal driving variation ratio, the coolant temperature simulated value THWE is corrected to a smaller value.

In the modification B, the condition of the normal driving variation ratio being less than the determination value is equivalent to the condition showing that the period in which the operating state has become a specific state before the establishment of the diagnosis condition (the difference between the detection value of the intake-air temperature sensor and the external air temperature is equal to or greater than the upper limit value) is equal to or longer than the upper limit period.

[3] On Modification C

As the modification C, the configurations of the following modification C1 to modification C3 can be applied. The modification C1 can be applied to the first embodiment, the modification C2 to the modification C1, and the modification C3 to the modification C2, respectively. In the modification C2 and the modification C3, the electronic control unit 9 includes the correction means.

The Modification C1: Each processing of the first embodiment is changed as follows.

(A) In the processing of step S122, an integrated time (idle integrated time) of the idle state from the starting of the engine 2 until the present time is calculated.

(B) In the processing of step S124, an integrated time (normal driving integrated time) of the normal driving state from the starting of the engine 2 until the present time is calculated.

(C) In the processing of step S212, a ratio (an integrated ratio (the idle integrated time/the normal driving integrated time)) of the idle integrated time for the normal driving integrated time is calculated.

(D) In the processing of step S220, the integrated ratio and the determination value are compared, thereby selecting the execution or suspension of the diagnosis. That is, when the integrated ratio is equal to or more than the determination value, the execution of the diagnosis is suspended (diagnosis suspension flag FC is tuned on). On the other hand, when the integrated ratio is less than the determination value, the execution of the diagnosis is permitted (the procedure proceeds to step S230).

The Modification C2: In the modification C1, when the integrated ratio is equal to or greater than the determination value, the coolant temperature simulated value THWE (determined coolant temperature simulated value THWEfin) is corrected to reduce it. The coolant temperature simulated value THWE after the correction and the coolant temperature measurement value THWM are compared, thereby executing the diagnosis of the operating state.

The Modification C3: In the modification C2, the correction degree for the coolant temperature simulated-value THWE is changed according to the magnitude of the integrated ratio. In this case, in proportion as the integrated ratio increases, the correction value of the coolant temperature simulated value THWE is set large. That is, accompanied with the increase in the integrated ratio, the coolant temperature simulated value THWE is corrected to a smaller value.

In the modification C, the condition of the integrated ratio being equal to or greater than the determination value is equivalent to the condition showing that the period in which the operating state has become a specific state before the establishment of the diagnosis condition (the difference between the detection value of the intake-air temperature sensor and the external air temperature is equal to or greater than the upper limit value) is equal to or longer than the upper limit period.

[4] On Modification D

As the modification D, the configurations of the following modification D1 to modification D3 can be applied. The modification D1 can be applied to the first embodiment, the modification D2 to the modification D1, and the modification D3 to the modification D2, respectively. In the modification D2 and the modification D3, the electronic control unit 9 includes the correction means.

The Modification D1: Each processing of the first embodiment is changed as follows.

(A) In the processing of step S122, an integrated time (idle integrated time) of the idle state from the starting of the engine 2 until the present time is calculated.

(B) In the processing of step S212, a ratio of the idle integrated time (idle time ratio) for the whole driving time of the current trip is calculated.

(C) In the processing of step S220, the idle time ratio and the determination value are compared, thereby selecting the execution or suspension of the diagnosis. That is, when the idle time ratio is equal to or more than the determination value, the execution of the diagnosis is suspended (diagnosis suspension flag FC is turned on). On the other hand, when the idle time ratio is less than the determination value, the execution of the diagnosis is permitted (the procedure proceeds to step S230). In this case, the processing of step S124 can be omitted.

The Modification D2: In the modification D1, when the idle time ratio is equal to or more than the determination value, the correction to reduce the coolant temperature simulated value THWE (determined coolant temperature simulated value THWEfin) is performed. The coolant temperature simulated value THWE after the correction and the coolant temperature measurement value THWM are compared, thereby executing the diagnosis of the operating state.

The Modification D3: In the modification D2, the correction degree for the coolant temperature simulated value THWE is changed according to the magnitude of the idle time ratio. In this case, in proportion as the idle time ratio increases, the correction value of the coolant temperature simulated value THWE is set large. That is, accompanied with the increase in the idle time ratio, the coolant temperature simulated value THWE is corrected to a smaller value.

In the modification D, the condition of the idle time ratio being equal to or greater than the determination value is equivalent to the condition showing that the period in which the operating state becomes a specific state before the establishment of the diagnosis condition (state in which difference between the detection value of the intake-air temperature sensor and the external air temperature is equal to or more than the upper limit value) is equal to or more than the upper limit period.

[5] On Modification E

As the modification E, the configurations of the following modification E1 to modification E3 can be applied. The modification E1 can be applied to the first embodiment, the modification E2 to the modification E1, and the modification E3 to the modification E2, respectively. In the modification E2 and the modification E3, the electronic control unit 9 includes the correction means.

Modification E1: Each processing of the first embodiment is changed as follows.

(A) In the processing of step S124, an integrated time (normal driving integrated time) of the normal driving state from the starting of the engine 2 until the present time is calculated.

(B) In the processing of step S212, the integrated time ratio of the whole driving time of the current trip to the normal driving (normal driving integrated time) is calculated.

(C) In the processing of step S220, the normal driving time ratio and the determination value are compared, thereby selecting the execution or suspension of the diagnosis. That is, when the normal driving time ratio is less than the determination value, the execution of the diagnosis is suspended (diagnosis suspension flag FC is turned on). On the other hand, when the normal driving time ratio is equal to or more than the determination value, the execution of the diagnosis is permitted (the procedure proceeds to step S230). In this case, the processing of step S122 can be omitted.

The Modification E2: In the modification E1, when the normal driving time ratio is less than the determination value, the correction to reduce the coolant temperature simulated value THWE (determined coolant temperature simulated value THWEfin) is performed. The coolant temperature simulated value THWE after the correction and the coolant temperature measurement value THWM are compared, thereby executing the diagnosis of the operating state.

Modification E3: In the modification E2, the correction degree for the coolant temperature simulated value THWE is changed according to the magnitude of the normal driving time ratio. In this case, in proportion as the normal driving time ratio decreases, the correction value of the coolant temperature simulated value THWE is set large. That is, accompanied with the decrease in the normal driving time ratio, the coolant temperature simulated value THWE is corrected to a smaller value.

In the modification E, the condition of the normal driving time ratio being less than the determination value is equivalent to the condition showing that the period in which the operating state becomes a specific state before the establishment of the diagnosis condition (state in which difference between the detection value of the intake-air temperature sensor and the external air temperature is equal to or more than the upper limit value) is equal to or longer than the upper limit period.

[6] On Modification F

As the modification F, the configurations of the following modification F1 to modification F3 can be applied. The modification F1 can be applied to the first embodiment, the modification F2 to the modification F1, and the modification F3 to the modification F2, respectively. In the modification F2 and the modification F3, the electronic control unit 9 includes the correction means.

The Modification F1: Each processing of the first embodiment is changed as follows.

(A) In the processing of step S212, an integrated value (intake amount integrated value) of the intake amount from the starting of the engine 2 until the present time is calculated.

(B) In the processing of step S220, the intake amount integrated value and the determination value are compared, thereby selecting the execution or suspension of the diagnosis. That is, when the intake amount integrated value is less than the determination value, the execution of the diagnosis is suspended (diagnosis suspension flag FC is turned on). On the other hand, when the intake amount integrated value is equal to or more than the determination value, the execution of the diagnosis is permitted (the procedure proceeds to step S230). In this case, the processings of steps S120, S122, and S124 can be omitted.

The Modification F2: In the modification F1, when the intake amount integrated value is less than the determination value, the correction to reduce the coolant temperature simulated value THWE (determined coolant temperature simulated value THWEfin) is performed. The coolant temperature simulated value THWE after the correction and the coolant temperature measurement value THWM are compared, thereby executing the diagnosis of the operating state.

The Modification F3: In the modification F2, the correction degree for the coolant temperature simulated value THWE is changed according to the magnitude of the intake amount integrated value. In this case, in proportion as the intake amount integrated value decreases, the correction value of the coolant temperature simulated value THWE is set large. That is, accompanied with the decrease in the intake amount integrated value, the coolant temperature simulated value THWE is corrected to a smaller value.

In the modification F, the condition of the intake amount integrated value being less than the determination value is equivalent to the condition showing that the period in which the operating state becomes a specific state before the establishment of the diagnosis condition (state in which difference between the detection value of the intake-air temperature sensor and the external air temperature is equal to or more than the upper limit value) is equal to or more than the upper limit period.

Second Embodiment

A second embodiment of the present invention will be explained with reference to FIGS. 12 to 15.

The present embodiment is a modification of the operating state diagnosis processing of the first embodiment, and is the same as the first embodiment except for the configurations explained below. The members and parameters common to the first embodiment can be applied with the explanations of the first embodiment.

The outline of an operating state diagnosis processing [2] of the present embodiment will be explained.

When an external air temperature difference DfTHWA is calculated, basically, an initial intake-air temperature measurement value THAMini is used as a minimum intake-air temperature measurement value THAMmin. On the other hand, as explained above, because of the temperature rise of an intake-air temperature sensor 91 itself, an intake-air temperature measurement value THAM shows a value exceeding the external air temperature.

Hence, in the present embodiment, by correcting an initial intake-air temperature measurement value THAMini to decrease it, the calculation of a simulated water temperature variation ΔTHWE is performed based on a minimum intake-air temperature measurement value THAMmin in which an deviation with an external air temperature is small.

With respect to an idle state and a normal driving state, due to the difference of the cooling degrees of an intake-air temperature sensor 91, a deviating degree between an intake-air temperature measurement value THAM and the external air temperature is also different. For this reason, the correction degree for the initial intake-air temperature measurement value THAMini is set to a different magnitude. That is, the correction value (idle correction value THAI) of the initial intake-air temperature measurement value THAMini in an idle state is set greater than the correction value (normal driving correction value THAD) of the initial intake-air temperature measurement value THAMini in a normal driving state. As a result, the initial intake-air temperature measurement value THAMini corrected in the idle state becomes a value smaller than the initial intake-air temperature measurement value THAMini corrected in the normal driving state.

<Operating State Diagnosis Processing [2]>

In the present embodiment, an operating state diagnosis processing [2] is executed in order to diagnose the operating state of a thermostat 61. The operating state diagnosis processing [2] is repeatedly executed every predetermined number of calculation cycles.

Referring to FIGS. 12 to 15, a detailed processing procedure of the operating state diagnosis processing [2] will be explained.

At step T100, a simulated water temperature updating processing [2] (FIG. 13) is started for performing the updating of the coolant temperature simulated value THWE. After the completion of the simulated water temperature updating processing [2], the procedure proceeds to the processing of step T200.

At step T200, an abnormal state detection processing [2] (FIG. 15) for performing the detection of the anomaly of the thermostat 61 is started based on a coolant temperature measurement value THWM and a coolant temperature simulated value THWE. After the termination of the abnormal state detection processing [2], the procedure proceeds to the processing of step T300.

At step T300, it is determined whether or not the diagnosis of the operating state of the thermostat 61 is executed through the abnormal state detection processing [2]. That is, it is determined whether or not either one of a flag (abnormal diagnosis flag FA) showing that the operating state of the thermostat 61 is abnormal or a flag (normal diagnosis flag FB) showing that the operating state of the thermostat 61 is normal is turned on.

When either one of the flags is turned on, the procedure proceeds to the processing of step S310.

When either one of the flags is not turned on, the present processing is temporarily terminated.

At step T310, it is determined whether or not the abnormal diagnosis flag FA is turned on.

When the abnormal flag FA is turned on, the procedure proceeds to the processing of step T312.

When the normal diagnosis flag FB is turned on, the procedure proceeds to the processing of step T314.

At step T312, the warning lamp 15 is turned on.

At step T314, the completion of the Operating State Diagnosis Processing is set. As a result, the processing of step T314 is completed, and the operating state diagnosis processing [2] is completed.

<Simulated Water Temperature Updating Processing [2]>

Figure 12:
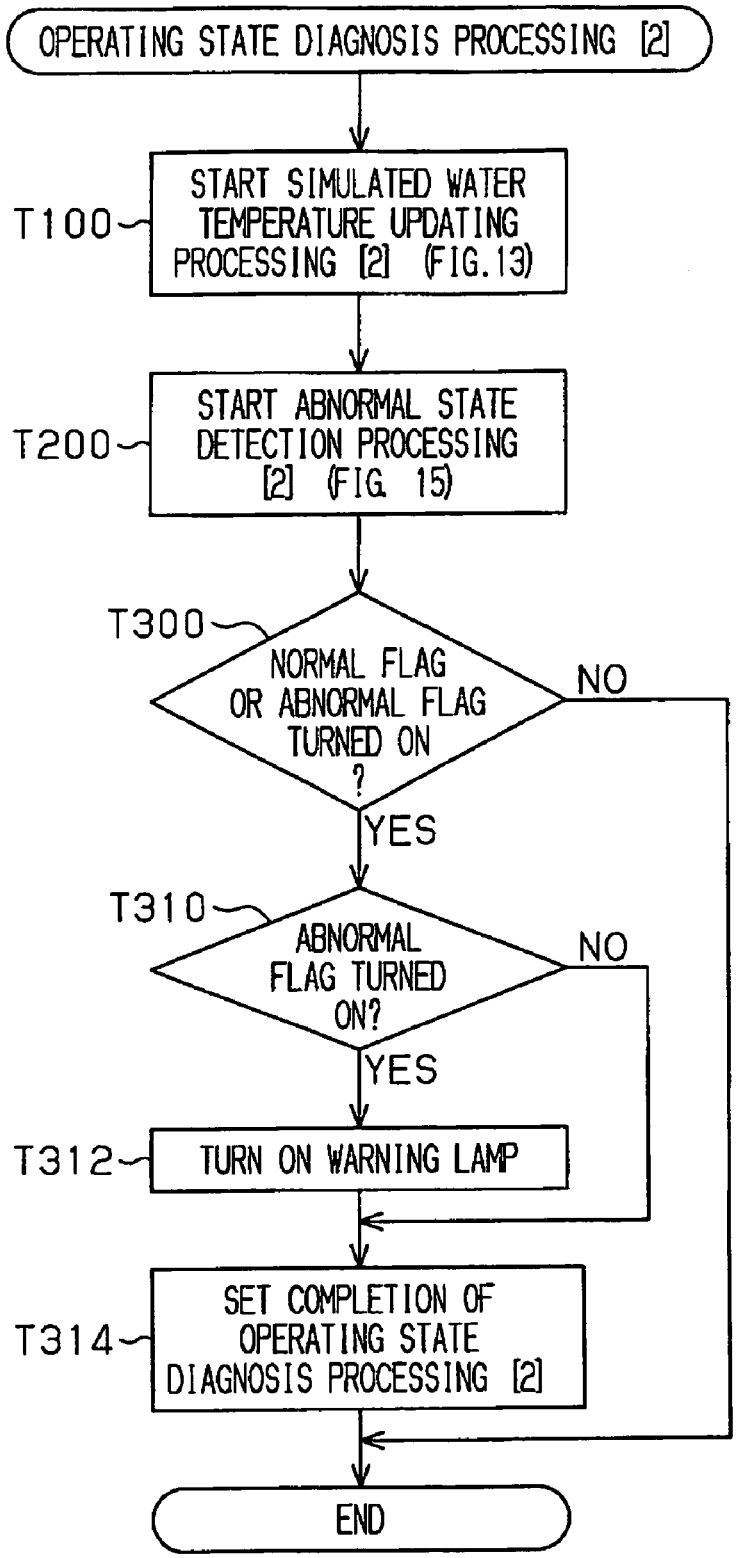
FIG. 12 is a flowchart showing an operating state diagnosis processing [2] executed according to a second embodiment.
Figure 13:
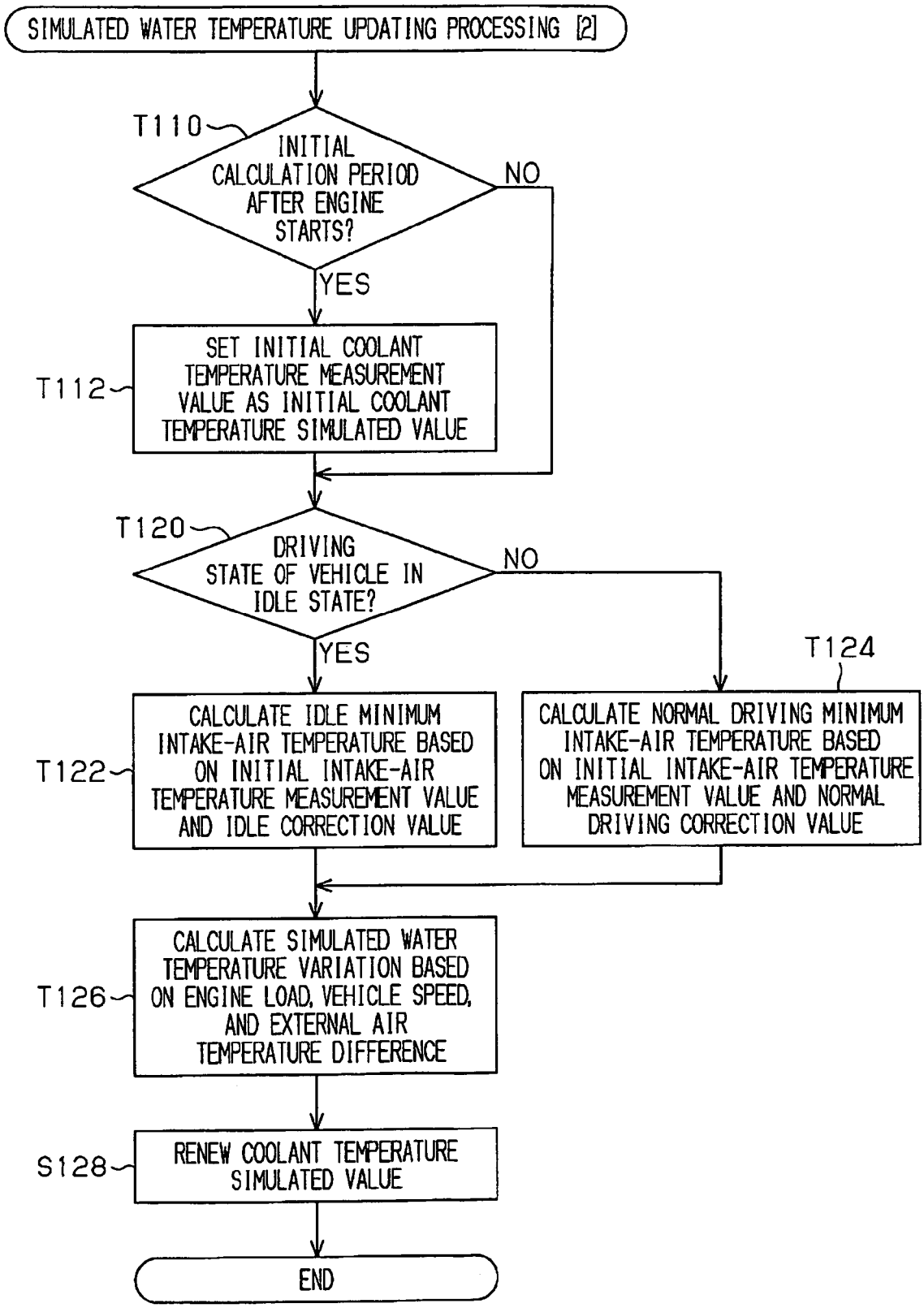
FIG. 13 is a flowchart showing a simulated water temperature updating processing [2]
Figure 14:
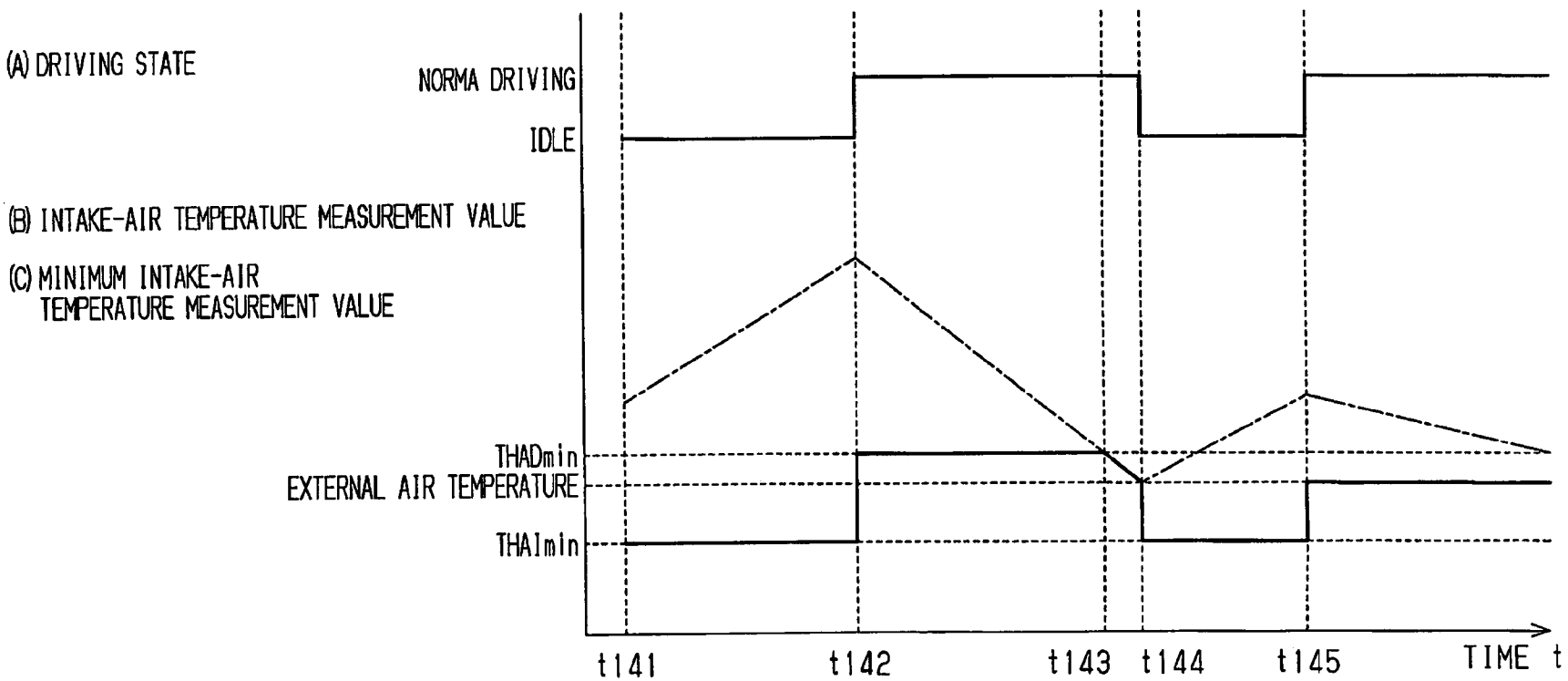
FIG. 14 is a timing chart showing one example of a calculation mode of the minimum intake-air temperature correction value in the simulated water temperature updating processing [2]

Referring to FIGS. 12, 13, and 14, the processing procedure of a simulated water temperature updating processing [2] will be explained.

At step T110, it is determined whether or not the current calculation cycle is the first calculation cycle after the starting of the engine 2.

When it is the first calculation cycle, the procedure proceeds to the processing of step T112.

When it is not the first calculation cycle, the procedure proceeds to the processing of step T114.

At step T112, an initial value (initial coolant temperature measurement value THWMini) of the coolant temperature measurement value THWM is set as an initial value (initial coolant temperature simulated value THWEini) of the coolant temperature simulated value THWE.

At step T120, it is determined whether or not the driving state of a vehicle 1 is in an idle state. Here, when idle operating conditions (the following conditions (a) and (b)) are established, it is determined that the driving state is an idle state. On the other hand, when the idle operating conditions are not established, it is determined that the driving state is not an idle state (normal driving state). The idle driving conditions are not limited to the following conditions (a) and (b), but appropriate conditions may be set.

(a) The depression amount of the accelerator pedal actuation is 0 (accelerator pedal is released).

(b) A vehicle speed measurement value SPDM is less than a determination value (the state of the vehicle 1 is a stopping or a state equivalent to the stopping).

Through the determination processing of step T120, the following processings are performed.

When the driving state is an idle state, the procedure proceeds to the processing of step T122.

When the driving state is a normal driving state, the procedure proceeds to the processing of step T124.

At step T122, an idle minimum intake-air temperature THAIimin is calculated by subtracting an idle correction value THAI from an initial intake-air temperature measurement value THAMini. That is, through the following Expression 21, the calculation of the idle minimum intake-air temperature THAImin is performed.

$$THAImin \leftarrow THAMini - THAI$$

The idle correction value THAI is set in advance through the tests and the like. Based on at least one of the parameters affecting the cooling degree of the intake-air temperature sensor 91 such as the driving time of the vehicle 1 and the integrated time and the like of the idle state in the current trip, the magnitude of the idle correction value THAI may be changed.

At step T124, a normal driving minimum intake-air temperature THADmin is calculated by subtracting a normal driving correction value THAD from the initial intake-air temperature measurement value THAMini. That is, through Expression 22, the calculation of the normal driving minimum intake-air temperature THADmin is performed.

$$THADmin \leftarrow THAMini - THAD \qquad \text{Expression 22}$$

The normal driving correction value THAD is set in advance through the tests and the like. Based on at least one of the parameters affecting the cooling degree of the intake-air temperature sensor 91 such as the driving time of the vehicle 1 and the integrated time and the like of the idle state in the current trip, the magnitude of the normal driving correction value THAD may be changed.

At step T126, a simulated water temperature variation ΔTHWE is calculated based on an engine load LE, a vehicle speed SPD, and an external air temperature difference DfTHWA. Specifically, through the processings of the following step T126-1 to step T126-3, the calculation of the simulated water. temperature variation ΔTHWE is performed.

At step T126-1, the minimum intake-air temperature measurement value THAMmin used in the calculation of the simulated water temperature variation ΔTHWE is set according to the following conditions (a) to (d).

(a) In the current calculation cycle, when the idle minimum intake-air temperature THAImin is calculated, and moreover, when the minimum intake-air temperature measurement value THAMmin obtained through the intake-air temperature sensor 91 is equal to or greater than the idle minimum intake-air temperature THAImin, the idle minimum intake-air temperature THAImin is set as the minimum intake-air temperature measurement value THAMmin.

(b) In the current calculation cycle, when the idle minimum intake-air temperature THAImin is calculated, and moreover, when the minimum intake-air temperature measurement value THAMmin obtained through the intake-air temperature sensor 91 is less than the idle minimum intake-air temperature THAImin, the minimum intake-air temperature measurement value THAMmin of the intake-air temperature sensor 91 is set as the minimum intake-air temperature measurement value THAMmin.

(c) In the current calculation cycle, when the normal driving minimum intake-air temperature THADmin is calculated, and moreover, when the minimum intake-air temperature measurement value THAMmin obtained through the intake-air temperature sensor 91 is equal to or greater than the normal driving minimum intake-air temperature THADmin, the normal driving minimum intake-air temperature THADmin is set as the minimum intake-air temperature measurement value THAMmin.

(d) In the current calculation cycle, when the normal driving minimum intake-air temperature THADmin is calculated, and moreover, when the minimum intake-air temperature measurement value THAMmin obtained through the intake-air temperature sensor 91 is less than the normal driving minimum intake-air temperature THADmin, the minimum intake-air temperature measurement value THAMmin of the intake-air temperature sensor 91 is set as the minimum intake-air temperature measurement value THAMmin.

When the minimum intake-air temperature measurement value THAMmin of the intake-air temperature sensor 91 falls below the idle minimum intake-air temperature THAImin or the normal driving minimum intake-air temperature THADmin, because of the cooling of the intake-air temperature sensor 91, it is presumed that an deviation between the intake-air temperature measurement value THAM (the minimum intake-air temperature measurement value THAMmin) and the external temperature is reduced. Hence, in the present embodiment, the minimum intake-air temperature measurement value THAMmin of the intake-air temperature sensor 91 is given priority and is used for the calculation of the simulated water temperature variation ΔTHWE. At least one of the conditions (b) and (d) is eliminated, so that the setting of the minimum intake-air temperature measurement value THAMmin can be also performed.

At step T126-2, each parameter used in the calculation of the simulated water temperature variation ΔTHWE is set as shown below.

(a) An intake-air ratio GAP calculated from an intake amount measurement value GAM of the current calculation cycle and the maximum intake amount GAmax are set as an engine load LE.

(b) A vehicle speed measurement value SPDM of the current calculation cycle is set as the vehicle speed SPD.

(c) The coolant temperature simulated value THWE of the current calculation cycle and an external intake-air temperature difference DfTHWB calculated from the minimum intake-air temperature measurement value THAMmin are set as the external air temperature difference DfTHWA.

At step T126-3, the simulated water temperature variation ΔTHWE is calculated by applying each parameter of step T126-2 to a map (simulated water temperature variation calculation map (FIG. 9)) set with a relationship between the engine load LE, the vehicle speed SPD, and the external air temperature difference DfTHWA and the simulated water temperature variation ΔTHWE. Here, as a setting format of the simulated water temperature variation calculation map, a two-dimensional map set with a relationship between the engine load LE and the external air temperature difference DfTHWA, and the simulated water temperature variation ΔTHWE is provided for each predetermined vehicle speed SPD.

At step T128, the coolant temperature simulated value THWE is updated by allowing the simulated water temperature variation ΔTHWE to be reflected in the present coolant temperature simulated value THWE (coolant temperature simulated value THWE calculated in the previous calculation cycle). That is, through Expression 23, the coolant temperature simulated value THWE is calculated.

$$THWE \leftarrow THWE + \Delta THWE \qquad \text{Expression 23}$$

In the present embodiment, the simulated water temperature variation ΔTHWE is adapted such that a curved line (simulated water temperature curved line LCC) tracing the change in the coolant temperature simulated value THWE in relation to time is located between a curved line (normal water temperature curved line LCA) tracing the change in the actual coolant temperature THW at the normal state of the thermostat 61 and a curved line (abnormal water temperature curbed line LCB) tracing the change in the actual coolant temperature THW at the abnormal state of the thermostat 61. That is, the coolant temperature simulated value THWE is updated so that the relationship among the simulated water temperature curved line LCC, the normal water temperature curved line LCA, and the abnormal water temperature curved line LCB becomes the relationship shown in FIG. 6. Hence, the coolant temperature simulated value THWE calculated through Expression 11 shows a value different from the actual coolant temperature THW at the normal state of the thermostat 61.

Referring to FIG. 14, one example of an updating mode of the minimum intake-air temperature measurement value THAMmin in the idle state and the normal driving state will be explained. Points in time t of FIG. 14 show the following timings, respectively.

Time t141: when the driving of the engine 2 is started.

Time t142: when the driving state of the vehicle 1 is changed from the idle state to the normal driving state.

Time t143: when the condition of THAMmin<THADmin is established.

Time t144: when the driving state of the vehicle 1 is changed from the normal driving state to the idle state.

Time t145: when the driving state of the vehicle 1 is changed from the idle state to the normal driving state.

When the driving state of the vehicle 1 is changed as explained above, the minimum intake-air temperature measurement value THAMmin is updated as follow.

(A) In the period from the time t141 to the time t142, since the driving state is in the idle state, the idle minimum intake-air temperature THAImin is set as the minimum intake-air temperature measurement value THAMmin.

(B) In the period from the time t142 to the time t143, since the driving state is in the normal driving state, the normal driving minimum intake-air temperature THADmin is set as the minimum intake-air temperature measurement value THAMmin.

(C) In the period from the time t143 to the time t144, since the condition of THAMmin<THADminis established, the minimum intake-air temperature measurement value THAMmin of the intake-air temperature sensor 91 is used for the calculation of the simulated water temperature variation ΔTHWE.

(D) In the period from the time t144 to the time t145, since the driving state is in the idle state, the idle minimum intake-air temperature THAImin is set as the minimum intake-air temperature measurement value THAMmin.

(E) Subsequent to the time t145, since the condition of THAMmin<THADmin is established, the minimum intake-air temperature measurement value THAMmin of the intake-air temperature sensor 91 is used for the calculation of the simulated water temperature variation ΔTHWE.

<Abnormal State Detection Processing [2]>

Figure 15:
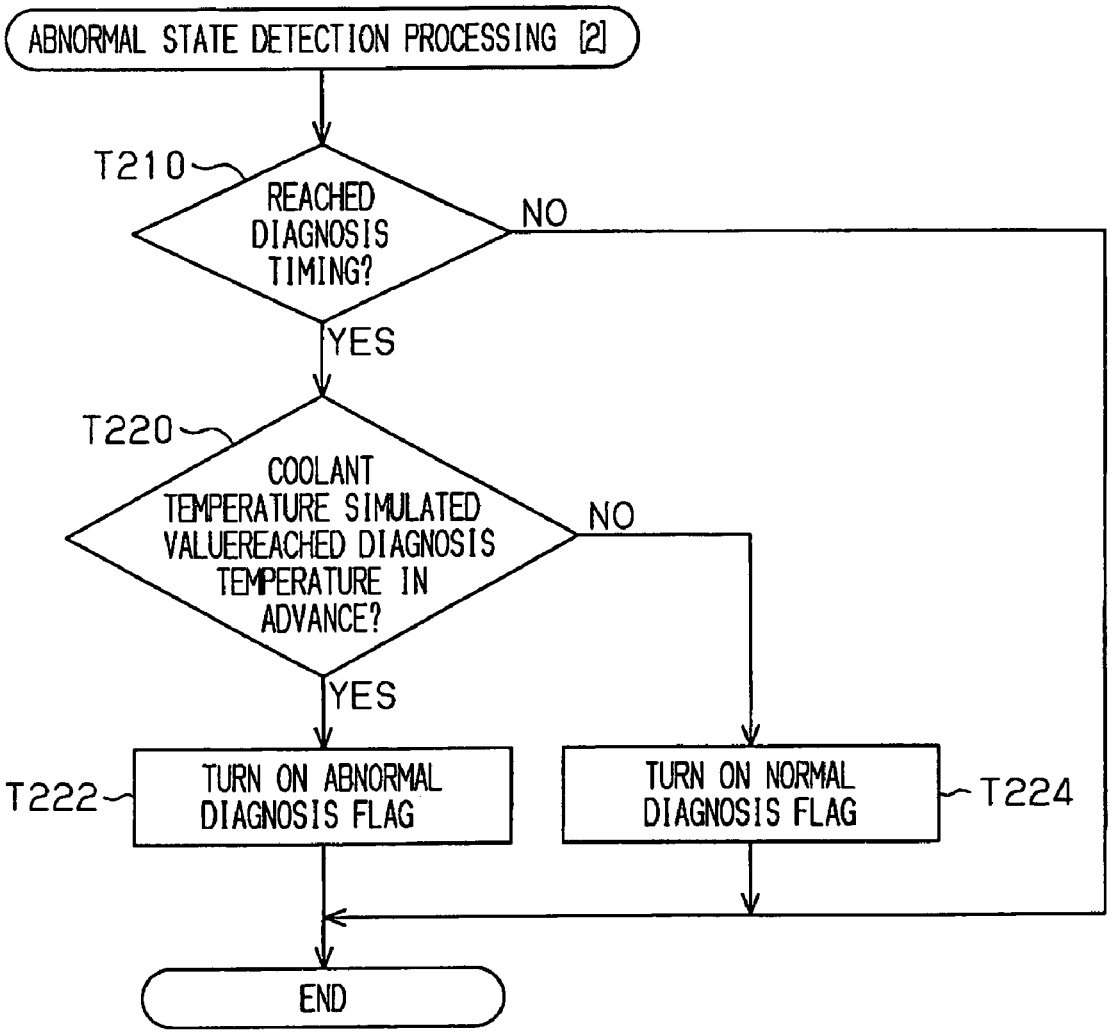
FIG. 15 is a flowchart showing an abnormal state detection processing [2].

Referring to FIG. 15, the processing procedure of an abnormal state detection processing [2] will be explained.

At step T210, it is determined whether or not a timing to perform the diagnosis of the operating state of the thermostat 61 has come (whether or not the diagnosis condition is established). That is, it is determined whether or not either one of the coolant temperature measurement value THWM or the coolant temperature simulated value THWE reaches the diagnosis temperature THWD.

When either one of the coolant temperature measurement value THWM or the coolant temperature simulated value THWE reaches the diagnosis temperature THWD, the procedure proceeds to the processing of step T220.

When either one of the coolant temperature measurement value THWM or the coolant temperature simulated value THWE does not reach the diagnosis temperature THWD, the present processing is temporarily suspended.

At step T220, it is determined whether or not the coolant temperature simulated value THWE reaches the diagnosis temperature THWD before the coolant temperature measurement value THWM.

When the coolant temperature simulated value THWE reaches the diagnosis temperature THWD in advance, the procedure proceeds to the processing of step T222.

When the coolant temperature measurement value THWM reaches the diagnosis temperature THWD in advance, the procedure proceeds to the processing of step T224.

At step T222, an abnormal diagnosis flag FA is turned on.

At step T224, a normal diagnosis flag FB is turned on. After the flag is set through the processing of step T222 or step T224, through the processings of the preceding step T300 onward, the operating state diagnosis processing is completed. The flag that is turned on through the processing of the step T222 or step T224 is initialized during the period from the completion of the operating state diagnosis processing by step T314 until the start of the next operating state diagnosis processing (the flag is turned off).

Advantage of the Embodiment

According to the second embodiment, the following advantage can be obtained.

(1) The coolant temperature simulated value THWE is updated based on a value obtained by for correcting the intake-air temperature measurement value THAM (initial intake-air temperature measurement value THAMini). As a result, an erroneous detection of the anomaly of the thermostat 61 is controlled. Hence, the detection accuracy of the anomaly of the thermostat 61 can be improved.

Other Embodiments

In addition, variable elements common to each embodiment will be shown below.

In each embodiment, though the diagnosis temperature THWD is set based on the reference value of the opened valve temperature THWT, an appropriate value may be taken as the diagnosis temperature THWD.

In each embodiment, though the diagnosis timing of the operating state is set based on the parameters (the coolant temperature measurement value THWM and the coolant temperature simulated value THWE) relating to the coolant temperature THW, the timing may be set based on an appropriate parameter (for example, the driving hours of the vehicle 1).

In each embodiment, though the intake-air temperature sensor 91 and the air flow meter 92 are provided inside the sensor unit 58, the intake-air temperature sensor 91 and the air flow meter 92 may be separately provided.

In each embodiment, though the present invention is applied to the cooling apparatus for the engine that directly injects fuel into the combustion chambers, the invention may be applied, for example, to an arbitrary engine provided with the cooling apparatus such as an engine and the like that inject fuel into an intake port. In this case also, operation and advantages according to each embodiment can be realized.

What is claimed is:

1. A cooling apparatus for an internal combustion engine, comprising:

a thermostat that adjusts a feed rate of a coolant to a radiator;

a detecting device that detects a temperature of said coolant;

an estimating device that estimates a reference temperature equivalent to the temperature of said coolant at least based on a detection value of an intake-air temperature sensor; and a diagnosis device that sets the temperature of said coolant detected by said detecting device to a detection temperature, and diagnoses an operating state of said thermostat by comparing said detection temperature and said reference temperature when a predetermined diagnosis condition is established, wherein a state in which a difference between the detection value of said intake-air temperature sensor and an external air temperature is equal to or greater than an upper limit value is set to a specific state, and wherein the diagnosis of said operating state is prohibited when a first time period of said specific state is equal to or longer than an upper limit time period, the upper limit time period being a period of time before the establishment of said diagnosis condition.

2. The cooling apparatus for the internal combustion engine according to claim 1, wherein said estimating device estimates said reference temperature when no anomaly occurs in said thermostat.

3. The cooling apparatus for the internal combustion engine according to claim 1, wherein said internal combustion engine is an engine that directly injects fuel into a combustion chamber.

4. A cooling apparatus for an internal combustion engine, comprising:

a thermostat that adjusts a feed rate of a coolant to a radiator;

a detecting device that detects a temperature of said coolant;

an estimating device that estimates a reference temperature equivalent to the temperature of said coolant at least based on a detection value of an intake-air temperature sensor;

a diagnosis device that sets the temperature of said coolant detected by said detecting device to a detection temperature and diagnoses an operating state of said thermostat by comparing said detection temperature and said reference temperature when a predetermined diagnosis condition is established; and a correction device, wherein a state in which a driving speed of a vehicle is less than a reference speed is set to a specific driving state, and wherein the correction device corrects said reference temperature when a ratio of a first time period of said specific driving state to a second time period measured from a starting of the internal combustion engine until an establishment of said diagnosis condition is equal to or greater than a predetermined determination value.

5. The cooling apparatus for the internal combustion engine according to claim 4, wherein said correction device increases a correction degree of said reference temperature in proportion to an increase in the ratio of the first time period to the second time period.

6. The cooling apparatus for the internal combustion engine according to claim 4, wherein said correction device corrects said reference temperature by reducing said reference temperature.

7. A cooling apparatus for an internal combustion engine, comprising:

a thermostat that adjusts a feed rate of a coolant to a radiator;

a detecting device that detects a temperature of said coolant;

an estimating device that estimates a reference temperature equivalent to the temperature of said coolant at least based on a detection value of an intake-air temperature sensor;

a diagnosis device that sets the temperature of said coolant detected by said detecting device to a detection temperature, and diagnoses an operating state of said thermostat by comparing said detection temperature and said reference temperature when a predetermined diagnosis condition is established; and a correction device that corrects said reference temperature when an integrated value of an intake amount from a starting of the internal combustion engine until an establishment of said diagnosis condition is less than a predetermined determination value.

8. The cooling apparatus for the internal combustion engine according to claim 7, wherein said correction device increases a correction degree of said reference temperature in proportion to a decrease in said integrated value.

9. A cooling apparatus for an internal combustion engine, comprising:

a thermostat that adjusts a feed rate of a coolant to a radiator;

a detecting device that detects a temperature of said coolant;

an estimating device that estimates a reference temperature equivalent to the temperature of said coolant at least based on an detection value of an intake-air temperature sensor;

diagnosis device that sets the temperature of said coolant detected by said detecting device to a detection temperature, and diagnoses an operating state of said thermostat by comparing said detection temperature and said reference temperature when a predetermined diagnosis condition is established; and a correction device, wherein a variation of said reference temperature during a first time period measured from a starting of the internal combustion engine until an establishment of said diagnosis condition is set to a first variation, and a variation of said reference temperature when the driving speed of a vehicle is less than a reference speed during the first time period is set to a second variation, and wherein the correction device corrects said reference temperature when a ratio of said second variation to said first variation is equal to or greater than a predetermined determination value.

10. The cooling apparatus for the internal combustion engine according to claim 9, wherein said correction device increases a correction degree of said reference temperature in proportion to an increase in the ratio of said second variation to said first variation.

11. A cooling apparatus for an internal combustion engine, comprising:

a thermostat that adjusts a feed rate of a coolant to a radiator;

a detecting device that detects a temperature of said coolant;

an estimating device that estimates a reference temperature equivalent to the temperature of said coolant at least based on an detection value of an intake-air temperature sensor;

a diagnosis device that sets the temperature of said coolant detected by said detecting device to a detection temperature, and diagnoses an operating state of said thermostat by comparing said detection temperature and said reference temperature when a predetermined diagnosis condition is established; and a correction device, wherein a variation of said reference temperature when a driving speed of a vehicle is equal to or greater than a reference speed during a first time period measured from a starting of the internal combustion engine until an establishment of said diagnosis condition is set to a first variation, and a variation of said reference temperature when the driving speed of the vehicle is less than said reference speed during the first time period is set to a second variation, and wherein the correction device corrects said reference temperature when a ratio of said second variation to said first variation is equal to or greater than a predetermined determination value.

12. The cooling apparatus for the internal combustion engine according to claim 11, wherein said correction device increases a correction degree of said reference temperature in proportion to an increase in the ratio of said second variation to said first variation.

13. A cooling apparatus for an internal combustion engine, comprising:

a thermostat that adjusts a feed rate of a coolant to a radiator;

a detecting device that detects a temperature of said coolant;

an estimating device that estimates a reference temperature equivalent to the temperature of said coolant at least based on an detection value of an intake-air temperature sensor;

a diagnosis device that sets the temperature of said coolant detected by said detecting device to a detection temperature, and diagnoses an operating state of said thermostat by comparing said detection temperature and said reference temperature when a predetermined diagnosis condition is established; and a correction device that calculates said reference temperature based on a value obtained by correcting the detection value of said intake-air temperature sensor to reduce the detection value of said intake-air temperature sensor.

14. The cooling apparatus for the internal combustion engine according to claim 13, wherein said correction device sets a first correction degree for said detection value when a driving speed of a vehicle is less than a reference speed to a larger value than a second correction degree for said detection value when the driving speed of the vehicle is equal to or greater than said reference speed.

15. A cooling apparatus for an internal combustion engine, comprising:

a thermostat that adjusts a feed rate of a coolant to a radiator;

a detecting device that detects a temperature of said coolant;

an estimating device that estimates a reference temperature equivalent to the temperature of said coolant at least based on a detection value of an intake-air temperature sensor; and a diagnosis device that sets the temperature of said coolant detected by said detecting device to a detection temperature, and diagnoses an operating state of said thermostat by comparing said detection temperature and said reference temperature when a predetermined diagnosis condition is established, wherein a state in which a depression amount of an accelerator pedal is less than a predetermined value and a driving speed of a vehicle is less than a reference speed is set to an idle state, and wherein the diagnosis of said operating state is prohibited when a ratio of a first time period of said idle state to a second time period measured from a starting of the internal combustion engine until an establishment of said diagnosis condition is equal to or greater than a predetermined determination value.

16. A cooling apparatus for an internal combustion engine, comprising:

a thermostat that adjusts a feed rate of a coolant to a radiator;

a detecting device that detects a temperature of said coolant;

an estimating device that estimates a reference temperature equivalent to the temperature of said coolant at least based on a detection value of an intake-air temperature sensor; and a diagnosis device that sets the temperature of said coolant detected by said detecting device to a detection temperature, and diagnoses an operating state of said thermostat by comparing said detection temperature and said reference temperature when a predetermined diagnosis condition is established, wherein the diagnosis of said operating state is prohibited when an integrated value of an intake amount drawn into the internal combustion engine from a starting of the internal combustion engine until an establishment of said diagnosis condition is less than a predetermined determination value.

17. A cooling apparatus for an internal combustion engine, comprising:

a thermostat that adjusts a feed rate of a coolant to a radiator;

a detecting device that detects a temperature of said coolant;

an estimating device that estimates a reference temperature equivalent to the temperature of said coolant at least based on a detection value of an intake-air temperature sensor; and a diagnosis device that sets the temperature of said coolant detected by said detecting device to a detection temperature, and diagnoses an operating state of said thermostat by comparing said detection temperature and said reference temperature when a predetermined diagnosis condition is established, wherein a variation of said reference temperature during a first time period measured from a starting of the internal combustion engine until an establishment of said diagnosis condition is set to a first variation, wherein a variation of said reference temperature when a driving speed of a vehicle is less than a reference speed during the first time period is set to a second variation, and wherein the diagnosis of said operating state is prohibited when a ratio of said second variation to said first variation is equal to or greater than a predetermined determination value.

18. A cooling apparatus for an internal combustion engine, comprising:

a thermostat that adjusts a feed rate of a coolant to a radiator;

a detecting device that detects a temperature of said coolant;

an estimating device that estimates a reference temperature equivalent to the temperature of said coolant at least based on a detection value of an intake-air temperature sensor; and a diagnosis device that sets the temperature of said coolant detected by said detecting device to a detection temperature, and diagnoses an operating state of said thermostat by comparing said detection temperature and said reference temperature when a predetermined diagnosis condition is established, wherein a variation of said reference temperature when a driving speed of a vehicle is equal to or greater than a reference speed during a first time period measured from a starting of the internal combustion engine until an establishment of said diagnosis condition is set to a first variation, wherein a variation of said reference temperature when the driving speed of the vehicle is less than said reference speed during the first time period is set to a second variation, and wherein the diagnosis of said operating state is prohibited when a ratio of said second variation to said first variation is equal to or greater than a predetermined determination value.

19. A cooling apparatus for an internal combustion engine, comprising:

a thermostat that adjusts a feed rate of a coolant to a radiator;

a detecting device that detects a temperature of said coolant;

an estimating device that estimates a reference temperature equivalent to the temperature of said coolant at least based on a detection value of an intake-air temperature sensor;

a diagnosis device that sets the temperature of said coolant detected by said detecting device to a detection temperature, and diagnoses an operating state of said thermostat by comparing said detection temperature and said reference temperature when a predetermined diagnosis condition is established; and a correction device, wherein a state in which the difference between the detection value of said intake-air temperature sensor and an external air temperature is equal to or greater than an upper limit value is set to a specific state, and wherein the correction device corrects said reference temperature when a first time period of said specific state is equal to or longer than an upper limit time period, the upper limit time period being a period of time before the establishment of said diagnosis condition.

* * * * *